US007743831B2

(12) United States Patent
Bunnell et al.

(10) Patent No.: US 7,743,831 B2
(45) Date of Patent: Jun. 29, 2010

(54) THERMAL ACTIVATION MECHANISMS AND METHODS FOR USE IN OILFIELD APPLICATIONS

(75) Inventors: Franz D. Bunnell, The Woodlands, TX (US); Jeff H. Moss, The Woodlands, TX (US); Jon Blacklock, Katy, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 11/918,509

(22) PCT Filed: May 30, 2006

(86) PCT No.: PCT/US2006/020936

§ 371 (c)(1),
(2), (4) Date: Nov. 19, 2008

(87) PCT Pub. No.: WO2006/135565

PCT Pub. Date: Dec. 21, 2006

(65) Prior Publication Data

US 2009/0205833 A1 Aug. 20, 2009

Related U.S. Application Data

(60) Provisional application No. 60/689,353, filed on Jun. 10, 2005.

(51) Int. Cl.
*E21B 36/04* (2006.01)

(52) U.S. Cl. ..... 166/302; 166/386; 166/373; 166/57

(58) Field of Classification Search ..... 166/386, 166/302, 373, 57
See application file for complete search history.

(56) References Cited

U.S. PATENT DOCUMENTS 3,716,101 A 2/1973 McGowen, Jr. et al.
4,390,324 A 6/1983 Karliner
4,501,337 A 2/1985 Dickinson, III et al.

(Continued)

FOREIGN PATENT DOCUMENTS

EP 0 962 622 A2 12/1999

(Continued)

OTHER PUBLICATIONS

European Search Report No. 112983, dated Nov. 24, 2005, for 2005UR016, 4 pages.

(Continued)

*Primary Examiner*—William P Neuder
*Assistant Examiner*—Nicole A Coy
(74) *Attorney, Agent, or Firm*—ExxonMobil Upstream Research Company - Law Department

(57) ABSTRACT

A method and apparatus associated with producing hydrocarbons. In one embodiment, the apparatus comprises at least one heating element that is disposed in a chamber with actuator material. A member is also partially coupled to the chamber. The member is configured to extend to a first configuration when the at least one heating element converts at least a portion of the actuator material from a first phase to a second phase and contract to a second configuration when the actuator material converts from the second phase to the first phase.

16 Claims, 14 Drawing Sheets

U.S. PATENT DOCUMENTS

| | | | | |
|---|---|---|---|---|
| 4,878,512 | A | 11/1989 | Pirkel | |
| 5,025,627 | A | 6/1991 | Schneider | |
| 5,706,896 | A | 1/1998 | Tubel et al. | |
| 6,113,355 | A | 9/2000 | Hult et al. | |
| 6,253,843 | B1 | 7/2001 | Rawson et al. | |
| 6,581,847 | B2 | 6/2003 | Kline et al. | |
| 6,582,198 | B2 | 6/2003 | Darby et al. | |
| 6,695,061 | B2 * | 2/2004 | Fripp et al. | 166/373 |
| 6,807,391 | B2 * | 10/2004 | Payne et al. | 399/106 |
| 2002/0023759 | A1 | 2/2002 | Deaton | |
| 2004/0026086 | A1 | 2/2004 | Patel | |
| 2004/0074894 | A1 | 4/2004 | Santanam | |
| 2005/0194149 | A1 * | 9/2005 | Giacomino | 166/369 |

FOREIGN PATENT DOCUMENTS

| | | | |
|---|---|---|---|
| GB | 2 328 492 | A | 2/1999 |
| GB | 2 332 263 | A | 6/1999 |
| WO | WO 00/66880 | | 11/2000 |

OTHER PUBLICATIONS

PCT International Search Report and Written Opinion, dated Feb. 1, 2007, Int'l Application No. PCT/US06/20936 (2005UR016), 7 pages.

* cited by examiner

THERMAL ACTIVATION MECHANISMS AND METHODS FOR USE IN OILFIELD APPLICATIONS

This application is the National Stage of International Application No. PCT/US05/20936, filed 30 May 2005, which claims the benefit of U.S. Provisional Application No. 60/689,353 filed on Jun. 10, 2005.

BACKGROUND

This section is intended to introduce the reader to various aspects of art, which may be associated with exemplary embodiments of the present invention, which are described and/or claimed below. This discussion is believed to be helpful in providing the reader with information to facilitate a better understanding of particular techniques of the present invention. Accordingly, it should be understood that these statements are to be read in this light, and not necessarily as admissions of prior art.

The production of hydrocarbons, such as oil and gas, has been performed for numerous years. To produce these hydrocarbons, a production system may utilize various devices, such as tools and valves, for specific tasks within a well. For instance, some devices are used to deploy packers and other tools within the well, while other devices are utilized to manage the flow of hydrocarbons from a subsurface formation to the surface. Accordingly, by utilizing these various devices, companies may produce hydrocarbons in an efficient manner.

However, the devices typically utilized in wells have certain limitations or problems that may effect the production of hydrocarbons. For instance, some devices, such as setting tools, typically utilize explosives to generate the force required for setting packers within the well. Because explosives are utilized, special handling is mandated by governmental regulations that relate to the transportation and use of the explosives. In particular, the regulations may prohibit transporting the explosives by air, require a dedicated explosive storage area, and require military/police escort for the explosives. In addition, the operational regulations may require radio silence from the time the setting tool is armed until the explosive device is detonated. Further, because the explosive material is only utilized once, the explosives are replaced after every operation, which may expose personnel to high-pressure gas trapped in the setting tool after the explosive charge has been ignited. Thus, the special handling restrictions increase operational costs because trained technicians are utilized to handle the explosives. As such, devices that utilize explosives present regulatory and safety issues that restrict the operation of the production system.

Similarly, other devices, such as hydraulic devices, present certain limitations or problems that may effect the production system. For instance, hydraulic devices may be utilized to control different valves in a well by relying on hydraulic fluid in small diameter control lines. With hydraulic devices, the number of control lines generally increases along with the number of valves being controlled. This number of control lines impacts the design and manufacture of other devices in the well because each device (e.g. tree, packers, seal assemblies, etc.) incorporates pass-through capability for the hydraulic control lines. Accordingly, the number of pass-through ports available to accommodate the control lines may limit the number of hydraulic valves that may be installed within the well. Further, while each additional pass-through port increases the manufacturing costs, it is also a potential leak point that increases the risk for a loss of pressure integrity in the production system. The leakage of hydraulic fluid may contaminate the surrounding environment, lead to damage of interior surfaces of equipment, and injure personnel. Finally, the length of the control lines also impact the responsivness of the devices managed by the control lines. This delay may be unacceptable for certain applications, such as a long interval completion or when a quick response time is required to active a device.

In addition, while other devices, such as electrical devices, may reduce the reliance on hydraulic control lines, these devices are typically complex and utilize large amounts of space. For instance, multiple electrical devices may be operated from an electric cable that provides power and signals to electric actuators and motors in the devices. However, electric motors generally produce small amounts of force relative to their size and weight. Further, electrical devices are generally complex because they utilize various components and circuitry to convert the power received into mechanical movement. This complexity and spatial footprint increase the cost associated with fabricating the electric devices. Finally, because of this complexity, the electric devices frequently breakdown and are not very reliable in wellbore applications.

Accordingly, the need exists for a reliable method or mechanism that efficiently controls devices within a production system.

SUMMARY OF INVENTION

In one embodiment, an apparatus associated with the production of hydrocarbons is described. The apparatus may include a body having a passage to allow hydrocarbons to flow through the apparatus. One or more actuators are coupled to the body and each includes a heating element is disposed within a chamber of the body along with an actuator material. A member is partially coupled to the chamber, adapted to move in a direction substantially parallel to the passage and configured to extend to a first configuration when the heating element converts a portion of the material from a first phase to a second phase and contract to a second configuration when the actuator material converts from the second phase to the first phase.

In a first alternative embodiment, a method of producing hydrocarbons is described. The method includes disposing an apparatus having a thermal actuator within a wellbore. Then, the method includes converting at least a portion of a material in the thermal actuator from a first phase to a second phase to place the apparatus into a first configuration. Finally, the method includes converting at least a portion of a material in the thermal actuator from the second phase to the first phase to place the apparatus into a second configuration.

In a second alternative embodiment, a system for producing hydrocarbons is described. This system includes a production tubing string disposed within a wellbore and utilized to produce hydrocarbons from a subsurface reservoir. An apparatus having a device and a thermal activation mechanism is disposed within the wellbore and coupled to the production tubing string. The thermal activation mechanism is coupled to the device and has at least one actuator. The actuator including a heating element disposed within a chamber along with actuator material and a portion of a member. The actuator is configured to extend to a first configuration when the heating element converts at least a portion of the actuator material from a first phase to a second phase and contract to a second configuration when the actuator material converts from the second phase to the first phase.

In a third alternative embodiment, a setting assembly is described. The setting assembly includes an actuator having at least one heating element, wherein each of the at least one heating elements is disposed within an actuator chamber of the setting assembly along with an actuator material and a member coupled to the actuator chamber. The member is configured to extend to a first configuration when the at least one heating element converts at least a portion of the actuator material from a first phase to a second phase; and contract to a second configuration when the actuator material converts from the second phase to the first phase. Further, the setting assembly includes a packer interface coupled to the member and adapted to engage with a packer.

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description, the specific embodiments of the present invention will be described in connection with its preferred embodiments. However, to the extent that the following description is specific to a particular embodiment or a particular use of the present techniques, it is intended to be illustrative only and merely provides a concise description of the exemplary embodiments. Accordingly, the invention is not limited to the specific embodiments described below, but rather; the invention includes all alternatives, modifications, and equivalents falling within the true scope of the appended claims.

The present technique includes a thermal activation mechanism that may be utilized in a variety of devices or applications within a production system to produce hydrocarbons from a well or to inject water, gas other treatment fluids into the well. Under the present technique, a thermal activation mechanism may include thermal actuators that utilize an expandable medium or material, such as wax or paraffin, to drive a member, such as a rod or piston, for example. Because the medium is enclosed within a variable volume chamber, the conversion of the medium from a first phase, such as solid phase, to a second phase, such as a liquid phase, may increase the volume of the medium and provide force to drive the member. That is, current is provided to a heating element, such as a heating coil, induction heating device, or other method of generating heat, to convert the medium between phases to drive the member and/or increase hydraulic pressure in a chamber. Because oilfield applications have larger force/displacement requirements and are typically located in hostile environments, the present techniques utilize this conversion to operate various tools and valves associated with the production of hydrocarbons from a well completion in an efficient manner.

Figure 1:
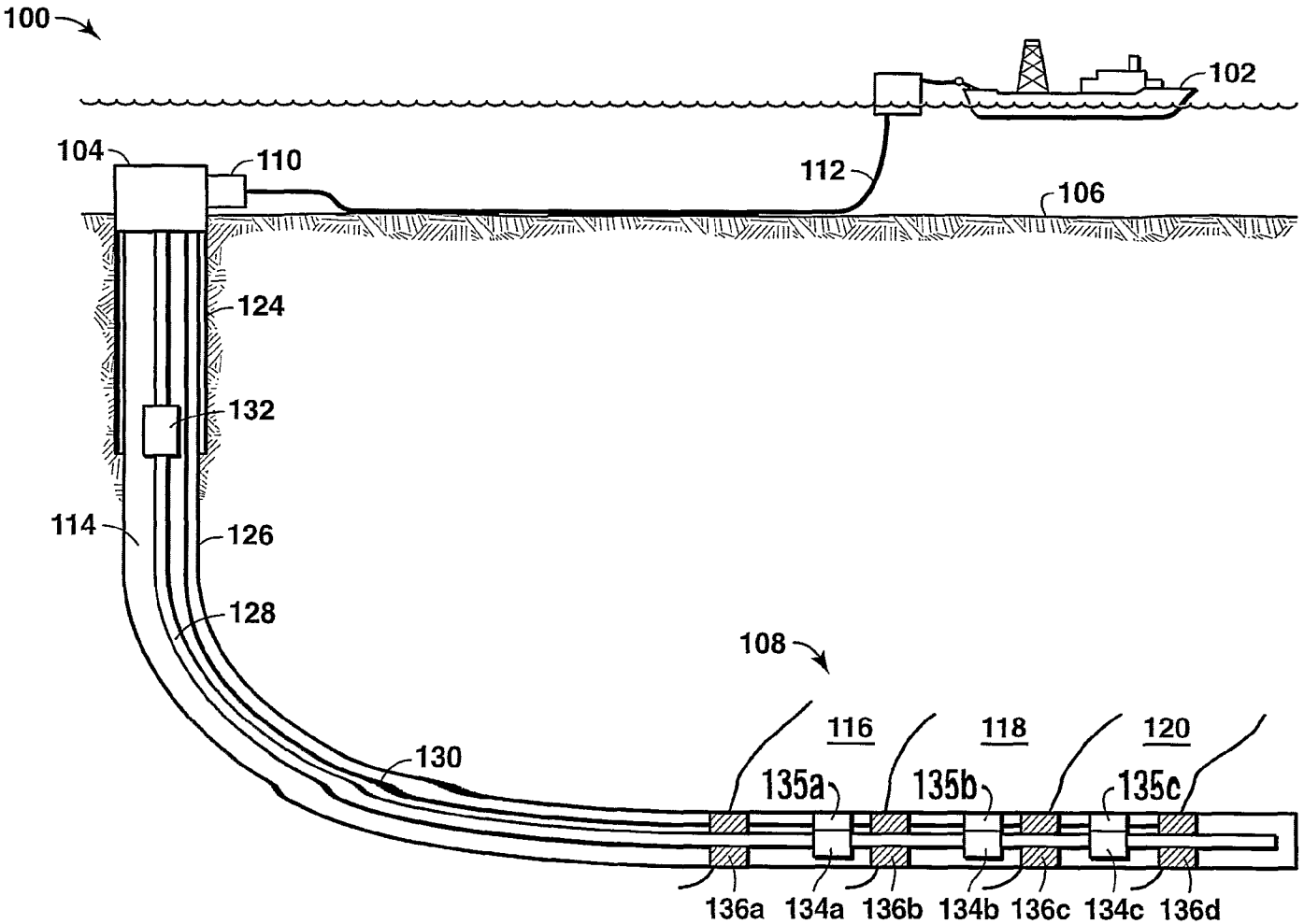
FIG. 1 is an exemplary production system in accordance with certain aspects of the present techniques.

Turning now to the drawings, and referring initially to FIG. 1, an exemplary production system 100 in accordance with certain aspects of the present techniques is illustrated. In the exemplary production system 100, a floating production facility 102 is coupled to a subsea tree 104 located on the sea floor 106. Through this subsea tree 104, the floating production facility 102 accesses a subsurface formation 108 that includes hydrocarbons, such as oil and gas. Beneficially, the valves and tools within the well utilize the present techniques to enhance the production of the hydrocarbons from this subsurface formation 108. However, it should be noted that the production system 100 is illustrated for exemplary purposes and the present techniques may be useful in the production or injection of fluids from any subsea, platform or land location.

The floating production facility 102 is configured to monitor and produce hydrocarbons from the subsurface formation 108. The floating production facility 102 may be a floating vessel capable of managing the production of fluids, such as hydrocarbons, from subsea wells. These fluids may be stored on the floating production facility 102 and/or provided to tankers (not shown). To access the subsurface formation 108, the floating production facility 102 is coupled to a subsea tree 104 and control valve 110 via a control umbilical 112. The control umbilical 112 may include production tubing for providing the hydrocarbons from the subsea tree 104, control tubing for hydraulic devices, and a control cable for communicating with various devices within the wellbore 114.

To access the subsurface formation 108, the wellbore 114 penetrates the sea floor 106 to a depth that interfaces with the subsurface formation 108. As may be appreciated, the subsurface formation 108 may include various layers of rock that may or may not include hydrocarbons and may be referred to as zones. In this example, the subsurface formation 108 includes a first zone 116, a second zone 118, and a third zone 120. Each of these zones 116-120 may include fluids, such as water, oil and/or gas. The subsea tree 104, which is positioned over the wellbore 114 at the sea floor 106, provides an interface between devices within the wellbore 114 and the floating production facility 102. Accordingly, the subsea tree 104 may be coupled to a production tubing string 128 to provide fluid flow paths and a control cable 130 to provide communication paths, which may interface with the control umbilical 112 at the subsea tree 104.

The production system 100 may also include various casing strings to provide support and stability for the wellbore 114. For example, a surface casing string 124 may be installed from the sea floor 106 to a location at a specific depth beneath the sea floor 106. Within the surface casing string 124, an intermediate or production casing string 126 may be utilized to provide support for walls of the wellbore 114. The production casing string 126 may extend down to a depth near the subsurface formation 108. Further, the surface and production casing strings 124 and 126 may be cemented into a fixed position within the wellbore 114 to further stabilize the wellbore 114.

To produce hydrocarbons from the subsurface formation 108, various devices may be utilized to provide flow control and isolation between different portions of the wellbore 114. For instance, a subsurface safety valve 132 may be utilized to block the flow of fluids from the production tubing string 128 in the event of rupture or break in the control cable 130 or control umbilical 112 above the subsurface safety valve 132. Further, the flow control valves 134*a*, 134*b*, and 134*c*, which may herein be referred to as flow control valves 134, are valves that regulate the flow of fluid through the wellbore 114 at specific locations. The surveillance devices 135*a*, 135*b* and 135*c*, which may herein be referred to as surveillance devices 135, are utilized to monitor or collect data about the wellbore 114 or flow of fluid through the respective valves 134. The surveillance devices 135 may include electronic gauges or other monitoring equipment that detect certain conditions, such as pressure, temperature, flow rate, etc., associated with the operation of the production system 100. Finally, packers 136*a*, 136*b*, 136*c*, and 136*d*, which may hereby collectively referred to as packers 136, may be utilized to isolate specific zones within the wellbore annulus from each other.

As noted above, other devices utilized in a well may exhibit certain problems that restrict or limit the operation of the production system 100. For instance, setting tools, which may be utilized to set packers 136, typically detonate explosives to generate the force required to expand the packers 136 within the wellbore 114 to seal off a specific portion of the wellbore annulus. The explosives utilized in the setting tools are heavily regulated and may result in delays for the installation of the packers in the well. Similarly, with hydraulic valves, a large number of control lines may become cumbersome as the number of hydraulic valves being controlled is increased. These control lines may hinder the operation or design of the well completion because each device associated with the wellbore 114, such as trees, packers, and/or seal assemblies, have to incorporate pass-through capability for each control line. These pass-through ports limit the number of devices that are supportable within the wellbore, increase the risk of leakage, and increase the manufacturing costs of the devices. Further, hydraulic valves have a delay that increases based upon the distance between the activation mechanism and the hydraulic valve. Finally, while electrical valves may reduce the number of hydraulic control lines, these valves produce little force in comparison to the size and weight of the electrical valves, are more complex, and less reliable than hydraulic valves.

Beneficially, the thermal activation mechanism of the present technique provides a mechanism that efficiently controls devices in an efficient and reliable manner with a single control line. Because a single control line may communicate with multiple thermal activation mechanisms, the number of devices utilized in the production system 100 is limited by the communication systems that provide the signals to the devices. That is, the limitations associated with the pass-through ports, spatial limitations, and reliability are reduced with the present techniques. For instance, the physical pass-through port constraints for a typical subsea tree are about nine ports, which may include hydraulic ports and electrical cables. By using the thermal activation mechanisms of the present techniques, the number of surveillance devices and valves that may be managed from a single electrical cable may exceed 100 devices.

Further, under the present techniques, the production system 100 may be an intelligent completion (IC) system, which is utilized to manage a variety of devices. For instance, if the subsurface formation 108 includes three zones that include hydrocarbons, such as zones 116, 118, and 120, then the production system 100 may include three flow control valves 134*a*, 134*b* and 134*c*, three surveillance devices 135*a*, 135*b* and 135*c*, four packers 136*a*, 136*b*, 136*c* and 136*d*, and one subsurface safety valve 132. Typically, this type of configuration includes at least one electric control line and between four to seven hydraulic control lines. Under the present, the production system 100 may utilize one electrical control line, such as control line 130, and one hydraulic control line. That is, the control line 130 may manage the three flow control valves 134*a*, 134*b* and 134*c* and three surveillance devices 135*a*, 135*b* and 135*c*, while the hydraulic control line manages the subsurface safety valve 132 and the subsea tree 104. However, if the subsurface safety valve 132 and the subsea tree 104 also utilize thermal activation mechanisms, then the control line 130 may manage the subsurface safety valve 132 and the subsea tree 104 without the use of any hydraulic control lines.

In addition, the thermal activation mechanisms of the present techniques may be utilized to position tools within the wellbore 114. For instance, a setting tool, which may be utilized to place packers 136 within the wellbore 114, may utilize the thermal activation mechanism. As such, the thermal activation mechanism may replace the explosive or pyrotechnic components of other setting tools. Accordingly, the thermal activation mechanism may enhance the production system 100 by providing a safer and more reliable mechanism for installing packers.

Beneficially, the present technique provides a mechanism that efficiently controls devices in an efficient and reliable manner with a single control line. By utilizing a thermally activated mechanism, an electrical signal may be utilized to convert a medium within a variable volume chamber to activate a valve or setting tool within the wellbore 114. That is, the thermally activated mechanism provides an efficient mechanism that does not rely on explosives, complex electric motors or circuitry, or numerous hydraulic control lines to active a valve, setting tool, or other similar device. Accordingly, exemplary embodiments of the flow control valves 110 and 134 are discussed in greater detail in FIGS. 2A, 2B, 2C, 3A, 3B and 3C, while exemplary embodiments of the subsea tree 104 are discussed in greater detail in FIGS. 4A and 4B. In addition, exemplary embodiments of the subsurface safety valve 132 are discussed in greater detail in FIGS. 5A, 5B and 5C, while exemplary embodiments of a setting tool used to deploy packers 136 are discussed in greater detail in FIGS. 6A and 6B.

To begin, with regard to FIGS. 2A, 2B, 2C, 3A, 3B and 3C, flow control valves, such as flow control valves 110 and 134, may be surface or monitored control devices that control the fluid flow profile for a portion of the wellbore 114. The flow control valves may include sleeves, control valves and injection valves, for example. While hydraulic flow control valves may be utilized, hydraulic flow control valves rely on one or more hydraulic control lines to operate the flow control valve. As noted above, each hydraulic control line requires devices to have pass-through ports. The pass-through ports increase manufacturing cost and introduce additional leak points, which increase the potential for a leak in overall production system 100. Also, the cost of the hydraulic control lines increases along with the depth of the wellbore. Furthermore, electric flow control valves that utilize gears and motors may also be utilized. However, as noted above, these valves do not provide a large amount of force for the associated footprint and are not as reliable. Accordingly, the use of the thermal activation mechanism in a first exemplary embodiment of a flow control valve is described in FIGS. 2A, 2B and 2C.

Figure 2A:
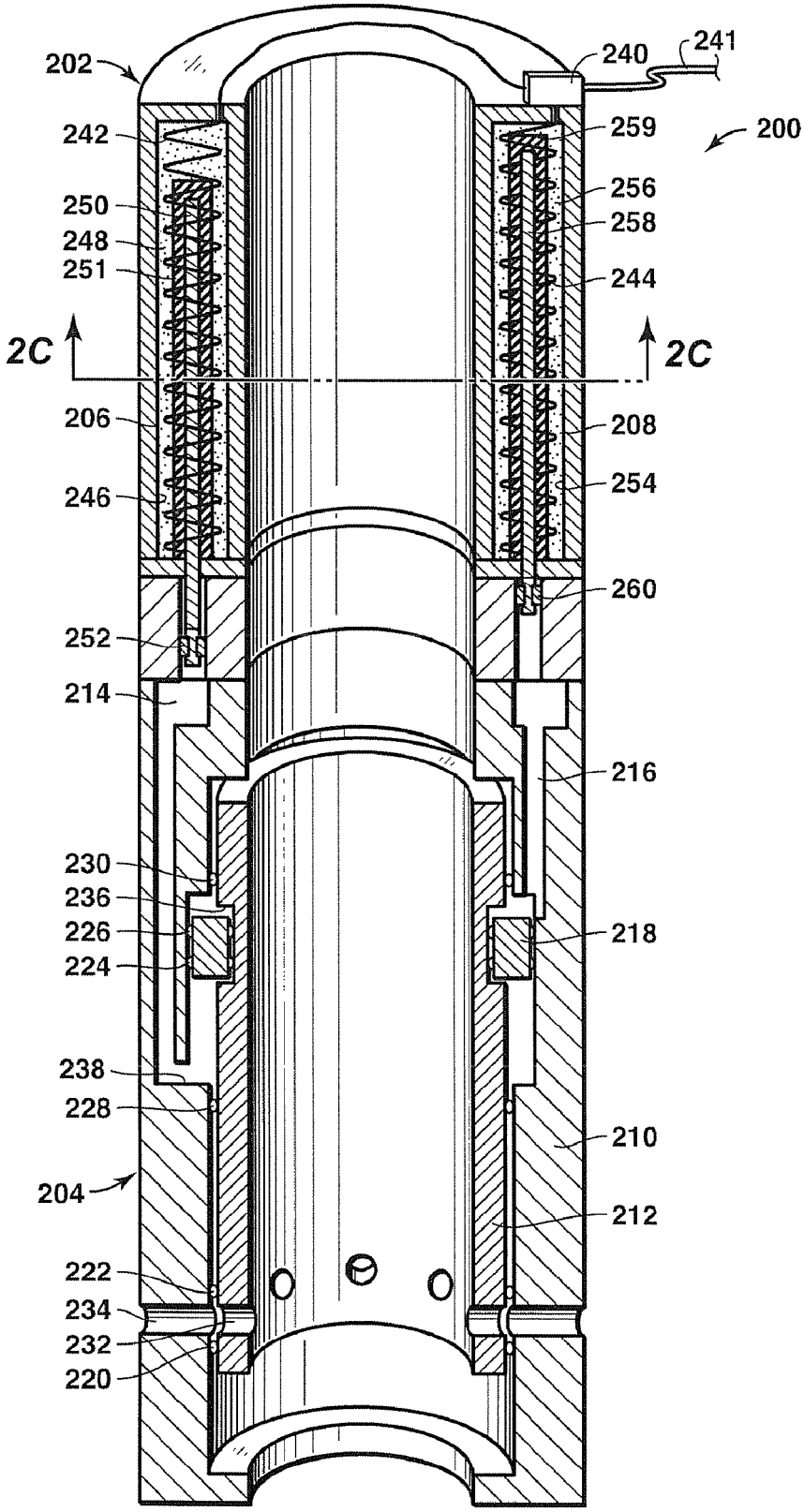
FIGS. 2A, 2B and 2C are exemplary embodiments of the flow control device of FIG. 1 having a thermal activation mechanism in accordance with certain aspects of the present techniques.
Figure 2B:
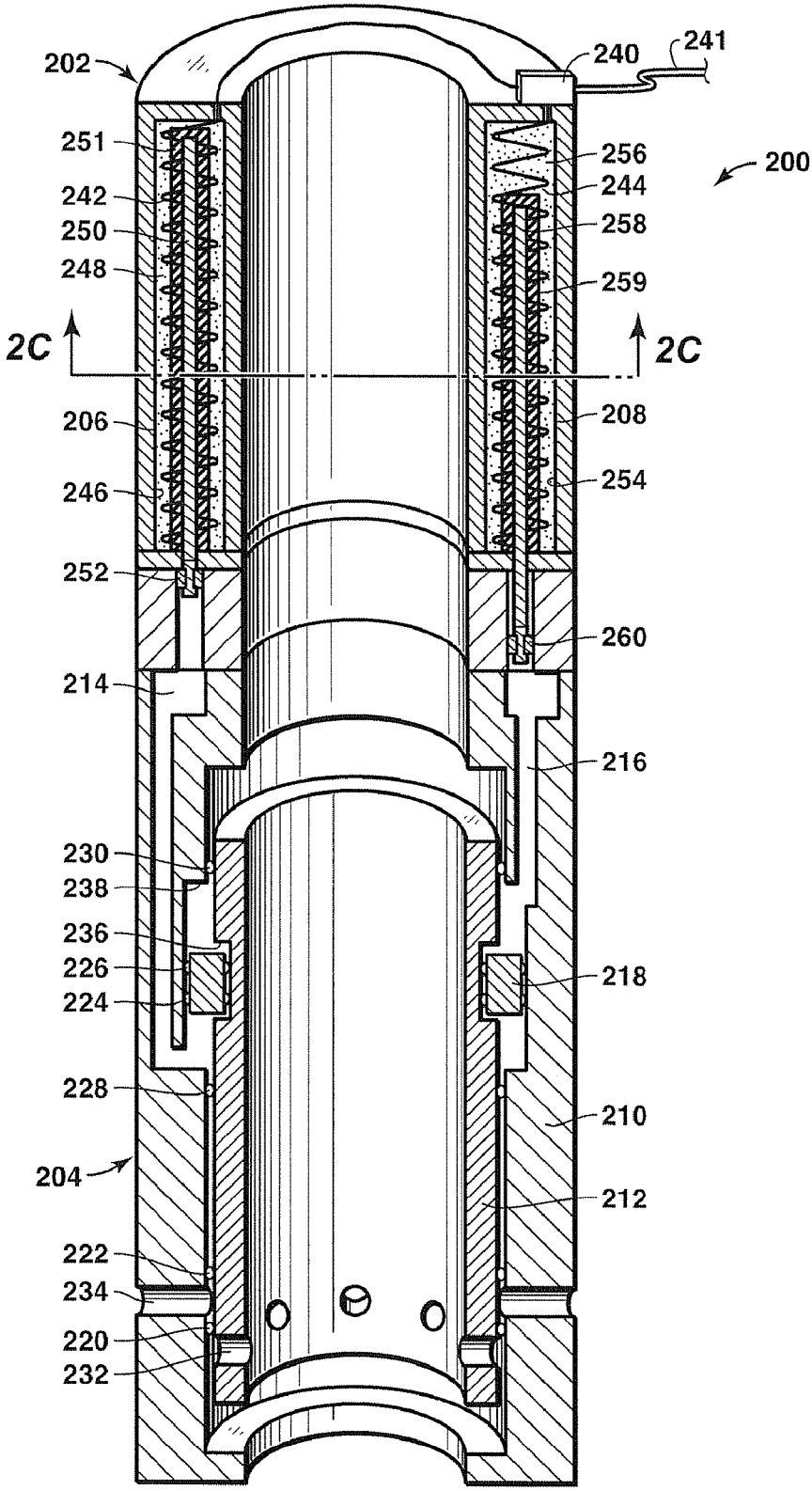
Figure 2C:
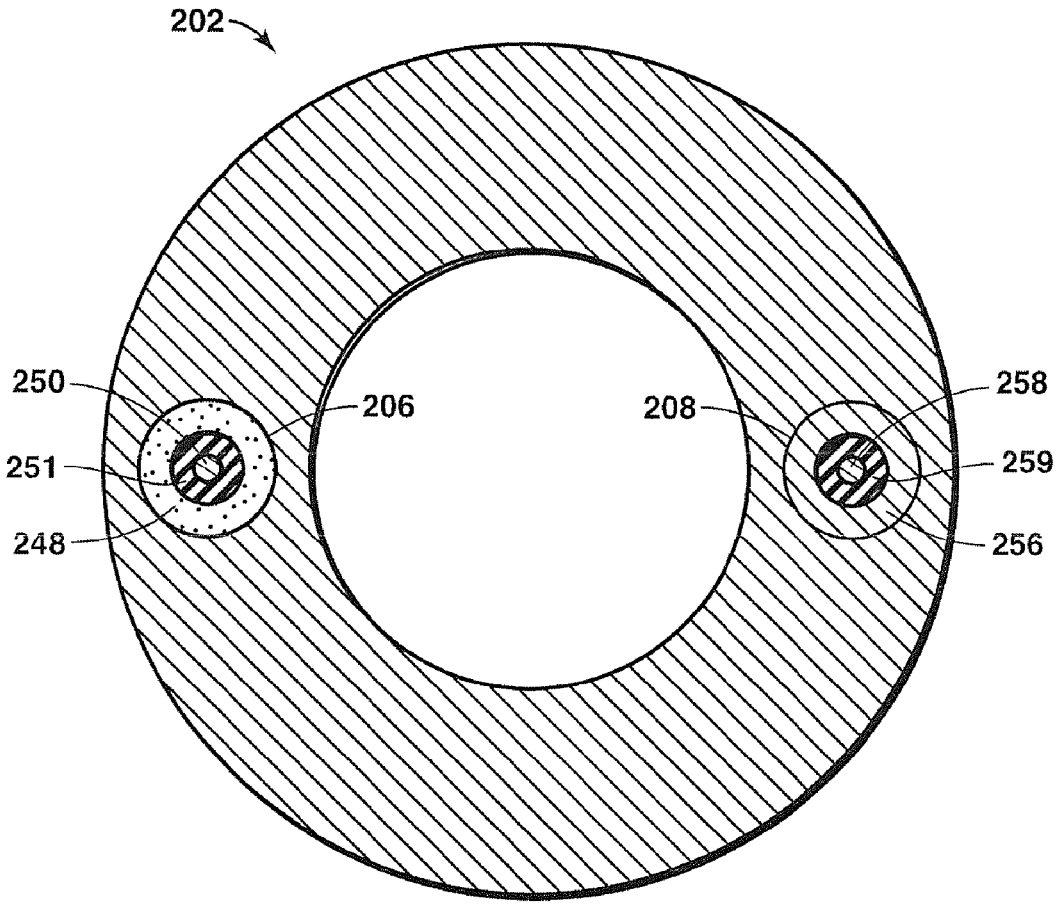

FIGS. 2A, 2B and 2C are exemplary embodiments of a flow control valve having a thermal activation mechanism in accordance with certain aspects of the present techniques. In this embodiment, the flow control valve, which may be the control valve 110 or 134, may be referred to by the reference numeral 200. The flow control valve 200 has central opening or passage for fluid flow through the flow control valve 200. This flow control valve 200 includes a thermal activation mechanism 202 that converts a medium between a first and second phase to generate pressure/force to adjust a valve 204. The thermal activation mechanism 202 has a first or opening actuator 206 to allow fluids to flow radially through the valve 204 and a closing actuator 208 to block fluids from flowing through the valve 204. That is, the thermal activation mechanism 202 may be utilized to position the valve 204 into an open or closed configuration.

The valve 204 includes a sleeve 212, two or more hydraulic chambers 214 and 216, at least one piston 218, and multiple seals 220-230 that are housed within a valve body 210. The sleeve 212 is slidably engaged with the valve body 210 to align a sleeve passage 232 with a valve body passage 234. In the open configuration, as shown in FIG. 2A, the sleeve passage 232 aligns with the valve body passage 234 to provide a radial fluid flow path through the valve body 210. In the closed position, as shown in FIG. 2B, the sleeve passage 232 is misaligned relative to the body passage 234 to disrupt the fluid flow path. The seals 220 and 222, which are each located between the valve body 210 and the sleeve 212, prevent fluid from flowing into the sleeve passage 232 or other portions of the valve body 210.

To adjust the fluid flow path, the sleeve 212 is engaged with the piston 218 that is controlled by the hydraulic pressure in the hydraulic chambers 214 and 216. The piston 218 is located at least partially within a sleeve notch 236 and valve body notch 238. The piston 218 is slidably engaged to move the sleeve 212 based on the pressure applied from the respective hydraulic chambers 214 and 216. The seals 224 and 226, which are located between the piston 218 and the valve body 210 or sleeve 212, isolate the hydraulic fluid in the hydraulic chambers 214 and 216 on either side of the piston 218. In the open configuration, as shown in FIG. 2A, the piston 218 is forced away from the valve body passage 234 by an increase in the hydraulic pressure in the first hydraulic chamber 214 relative to the second hydraulic chamber 216. In the closed configuration, as shown in FIG. 2B, the piston 218 is forced toward the valve body passage 234 by an increase in hydraulic pressure in the second hydraulic chamber 216 relative to the first hydraulic chamber 214. The seals 228 and 230, which are each located between the valve body 210 and the sleeve 212, prevent fluids from passing to the hydraulic chambers 214 and 216 or other portions of the valve 204.

To control the valve 204, the thermal activation mechanism 202 is utilized to adjust the valve 204 between the open and closed configurations. The thermal activation mechanism 202 includes the opening actuator 206 engaged with the first hydraulic chamber 214 and a closing actuator 208 engaged with the second hydraulic chamber 216. Control logic 240 is coupled to the actuators 206 and 208 via respective heating elements or coils 242 and 244. The control logic 240 is configured to receive and respond to certain control signals from the control line 241, which may be cabling from the control umbilical 112, control line 130, or another cable. The control logic 240 may also be coupled to monitors or sensors, such as the surveillance devices 135 of FIG. 1 or position feedback circuitry via the control line 241 to provide power to the heating coils 242 and 244. The control signals may include an indication specific to the thermal activation mechanism 202 to open or close the valve 204 or may include indications for other devices to perform specific functions. For an alternative perspective on the actuators 206 and 208, a cross sectional view of the actuators 206 and 208 along the line 2C is shown in FIG. 2C.

The opening actuator 206 includes an opening heating coil 242, opening chamber 246, opening medium or material 248, opening member or rod 250, an opening squeeze boot 251 and opening seal 252. The opening heating coil 242 is disposed within the opening chamber 246 along with the opening material 248 and the opening squeeze boot 251. The opening material 248 may include paraffin, wax or other medium that may expand when the medium changes from one phase to another, such as from a solid phase to a liquid phase. For instance, the opening material 248 may be paraffin configured to expand by about or at least 15% volume when the paraffin changes from a solid phase to a liquid phase. Alternatively, the opening material 248 may expand in a range from about 10% to about 20% when the paraffin changes from a solid phase to a liquid phase. Also, the opening material 248 may be adapted to remain in a solid phase up to certain temperatures, such as temperatures up to about 225° F. (Fahrenheit), temperatures above 225° F., or other suitable temperature for specific application. The opening squeeze boot 251 is disposed around the rod 250 to isolate the rod 250 from the opening material 248. The opening seal 252 may isolate the opening material 248 from the hydraulic fluid in the first hydraulic chamber 214.

Similar to the opening actuator 206, the closing actuator 208 includes a closing heating element or coil 244, closing chamber 254, closing medium or material 256, closing member or rod 258, closing squeeze boot 259 and closing seal 260. The closing heating coil 244 is disposed within the closing chamber 254 along with the closing material 256 and the closing squeeze boot 259. The closing material 256 may be the same or similar material to the opening material 248, but may also be different. The closing squeeze boot 259 is disposed around the rod 258 to isolate the rod 258 from the closing material 256. The closing seal 260 may isolate the closing material 256 from the hydraulic fluid in the second hydraulic chamber 216.

To control the configuration of the valve 204, the control logic 240 provides power or current to one of the heating coils 242 and 244. The heat generated from the heating coil 242 or 244 converts either the opening material 248 or the closing material 256 into the liquid phase. This conversion increases the pressure within the respective chamber 246 or 254 to force the rod 250 or 258 into one of the hydraulic chambers 214 or 216. As a specific example, the control logic 240 may provide current to the opening heating coil 242, but not to the closing heating coil 244. With this current, the opening heating coil 242 converts the opening material 248 into at least a partial liquid phase, while the closing material 256 remains in or converts to at least a partial solid phase. Because the opening chamber 246 is a sealed variable volume chamber, the expansion of the opening material 218 forces the opening rod 250 to be partially expelled through the opening seal 242 into the hydraulic chamber 214. The opening rod 250 is moved in a direction that is substantially parallel to the passage. As a result, the pressure in the hydraulic chamber 214 increases to force the piston 218 to align the passages 232 and 234.

Alternatively, the control logic 240 may provide current to the closing heating coil 244, but not to the opening heating coil 242. With this current, the closing heating coil 244 converts the closing material 256 into at least a partial liquid phase, while the opening material 248 remains in or converts to at least a partial solid phase. Because the closing chamber 254 is a sealed variable volume chamber, the expansion of the closing material 256 forces the closing rod 258 to be partially expelled through the closing seal 260 into the hydraulic chamber 216. It should be noted that without current being provided to the either or both of the heating coils 242 or 244, the materials 248 and 256 cool into the solid phase. In this situation, the hydraulic pressure would not change, which results in the configuration remaining unchanged.

Beneficially, the use of the thermal activation mechanism 202 enhances the operation of the production system 100. For instance, while the actuators 206 and 208 rely on the conversion between phases of the materials 248 and 256, the actuators 206 and 208 are responsive to control signals without the time delays associated with hydraulic systems that dependent upon the length of the hydraulic control line. Further, because the thermal activation mechanism 202 utilizes the control line 241, the cost and design limitations associated with hydraulic control lines and pressure conduits is reduced, and leak potential is eliminated. Also, the actuators 206 and 208 are not complex and do not consume a large amount of space, while providing the force for adjusting the configuration of the valve 204. As such, the thermal activation mechanism 202 provides an efficient and reliable mechanism to control devices within the production system 100. Another embodiment of a thermal activation mechanism in a flow control valve is described in FIGS. 3A, 3B and 3C.

Figure 3A:
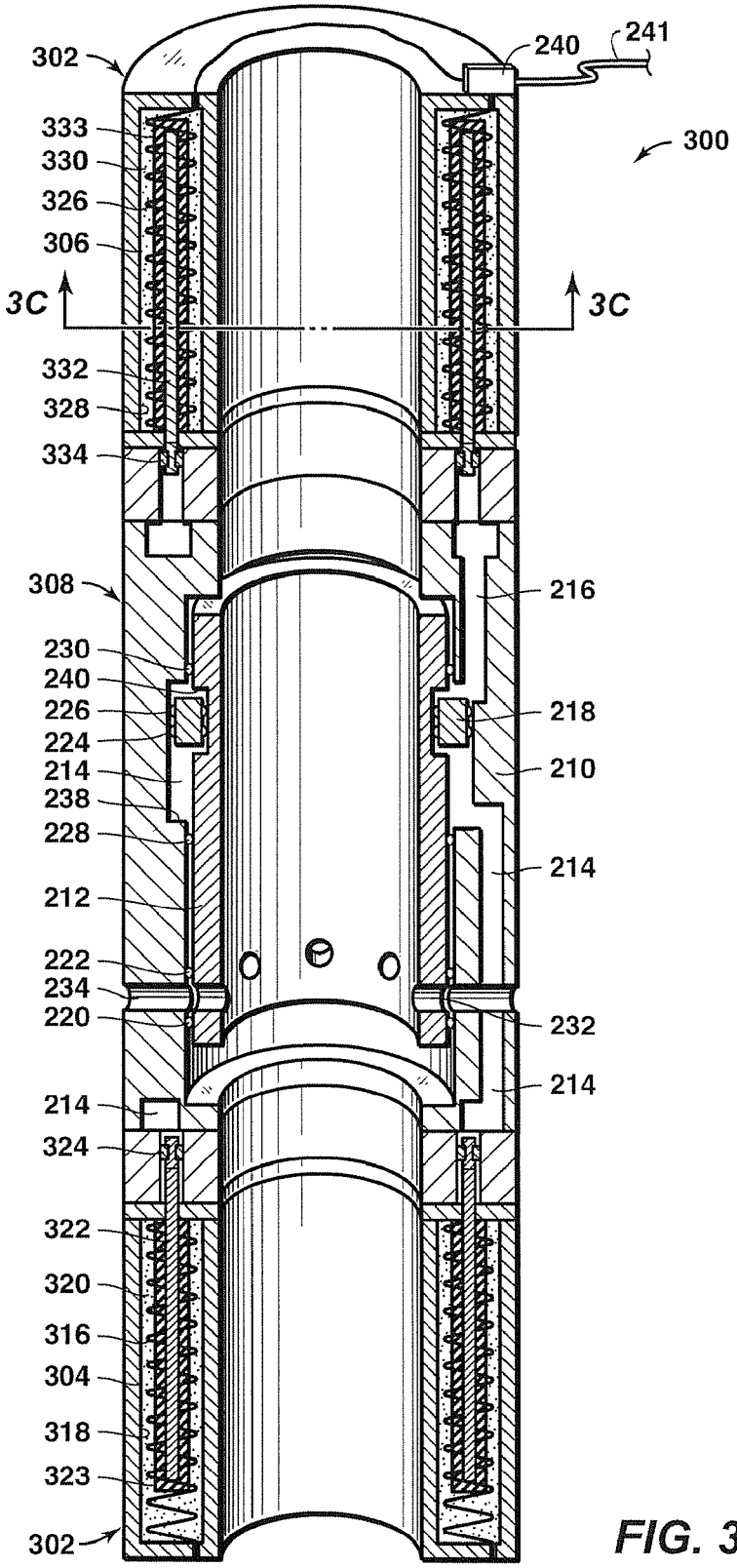
FIGS. 3A, 3B and 3C are exemplary alternative embodiments of the flow control device of FIG. 1 having a concentric thermal activation mechanism in accordance with certain aspects of the present techniques.
Figure 3B:
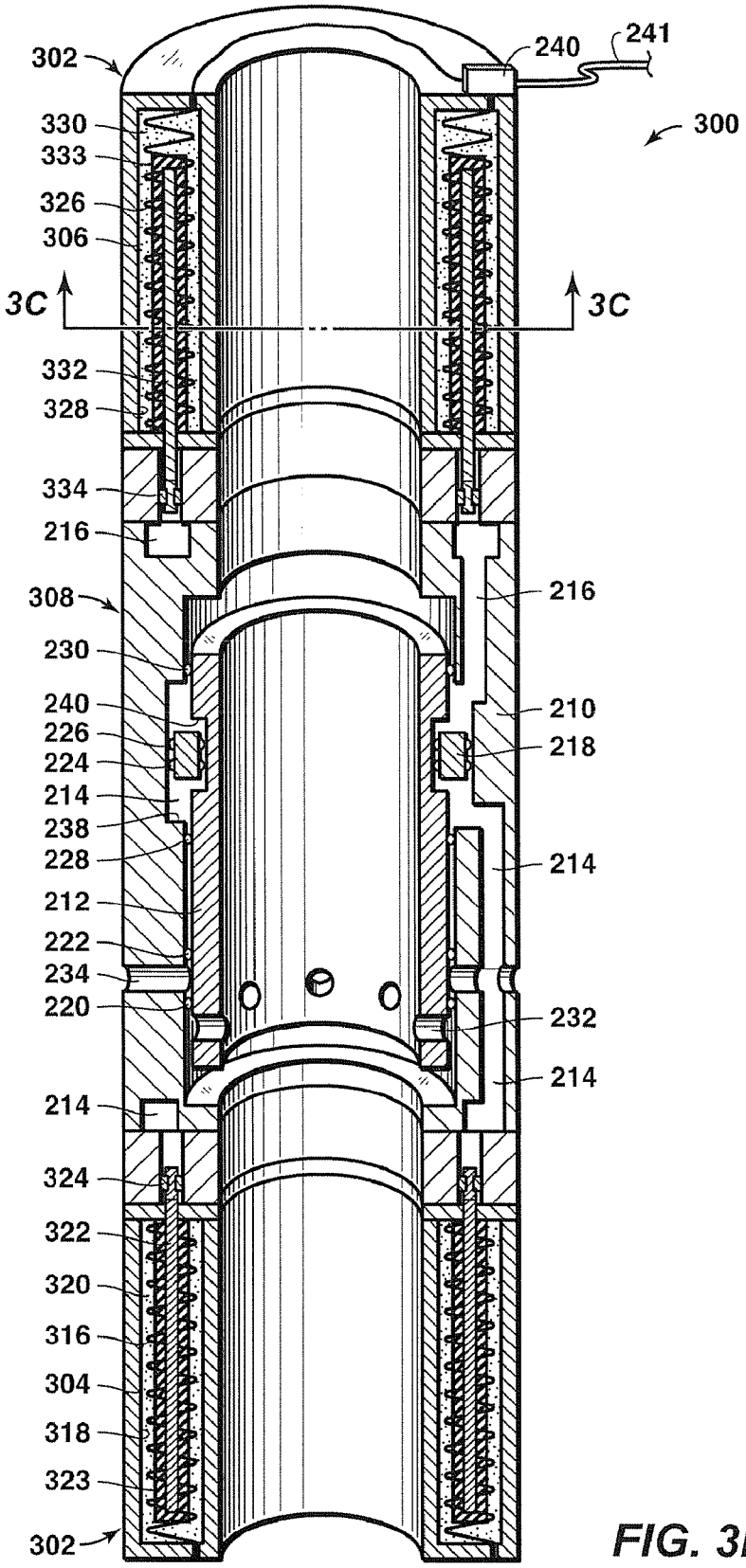
Figure 3C:
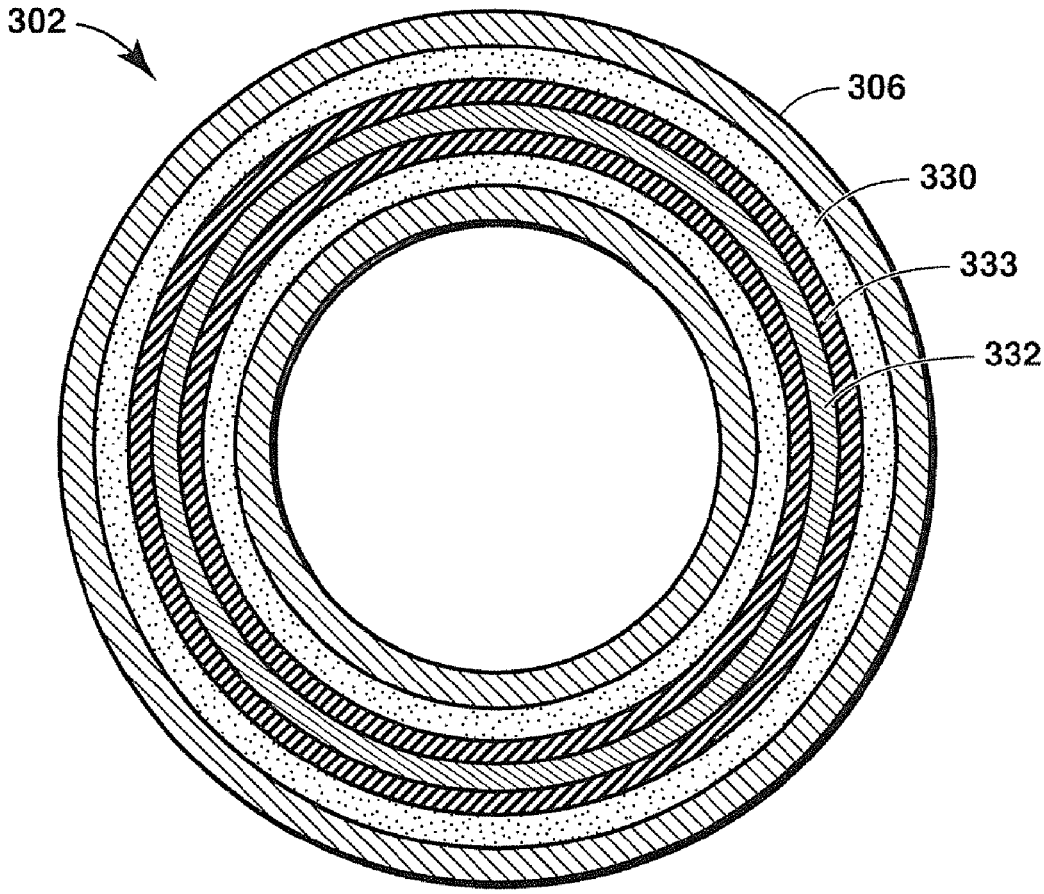

FIGS. 3A, 3B and 3C are exemplary alternative embodiments of a flow control valve having a thermal activation mechanism in accordance with certain aspects of the present techniques. In these embodiments, the flow control valve, which may be the control valves 110 or 134, may be referred to by the reference numeral 300. The flow control valve 300 may include a thermal activation mechanism 302 that has an opening actuator 304 and a closing actuator 306, which may operate together in a manner similar to the thermal activation mechanism 202 of FIGS. 2A and 2B. These actuators 304 and 306 are utilized to control a valve 308, which may also be similar to the valve 204 of FIGS. 2A and 2B. Accordingly, the current embodiments may be best understood by concurrently viewing FIGS. 2A and 2B.

The valve 308 includes the sleeve 212, two or more hydraulic chambers 214 and 216, at least one piston 218, and multiple seals 220-230 that are housed within a valve body 210. In this valve 308, the first hydraulic chamber 214 is configured to interact with the opening activation mechanism 304, while the second hydraulic chamber 216 is configured to interact with the closing activation mechanism 306. Similarly, the sleeve 212 is slidably engaged with the valve body 210 to align the sleeve passage 232 with the valve body passage 234. The operation of the sleeve 212, hydraulic chambers 214 and 216 and piston 218 are similar to the discussion above.

The opening actuator 304 operates similar to the opening actuator 206, but is disposed in a concentric manner with respect to the opening in the flow control valve 300. The opening actuator 304 includes an opening heating element or coil 316, opening chamber 318, opening material 320, opening member or rod 322, opening squeeze boot 323 and opening seal 324. The opening heating coil 316 is disposed within the opening chamber 318 along with the opening material 320. The opening material 320 may be the same material as the opening material 248 or different material based on predetermined characteristics, such as expansion volume and/or operational range, for example. The opening squeeze boot 323 is disposed around the opening rod 322 to isolate the opening rod 322 from the opening material 320. The opening seal 324 may isolate the opening material 320 from the hydraulic fluid in the first hydraulic chamber 214.

Similarly, the closing actuator 306 operates similar to the closing actuator 208. Again, the closing actuator 306 is disposed in a concentric manner with respect to the central opening in the flow control valve 300, as shown along the line 3C in FIG. 3C. The closing actuator 306 includes a closing heating element or coil 326, closing chamber 328, closing material 330, closing member or rod 332, closing squeeze boot 333 and closing seal 334. The closing heating coil 326 is disposed within the closing chamber 328 along with the closing material 330. The closing material 330 may be the same or similar material to the closing material 256, but may also be different to adjust the rate for various predetermined characteristics, as noted above. The closing squeeze boot 333 is disposed around the closing rod 332 to isolate the closing rod 332 from the closing material 330. The closing seal 334 may isolate the closing material 330 from the hydraulic fluid in the second hydraulic chamber 216.

To control the configuration of the valve 308, the control logic 240 provides current to one of the actuators 304 and 306. Similar to the discussion above, the heat generated from the heating coil 316 or 326 in the respective actuators 304 and 306 converts either the opening material 320 or the closing material 330 into the liquid phase. This conversion increases the pressure within the respective chambers 318 or 328 to force either the opening rod 322 or the closing rod 332 into one of the hydraulic chambers 214 or 216 to move the piston 218. The movement of the piston 218 adjusts the sleeve 212 into the associated opened or closed configuration.

Figure 4A:
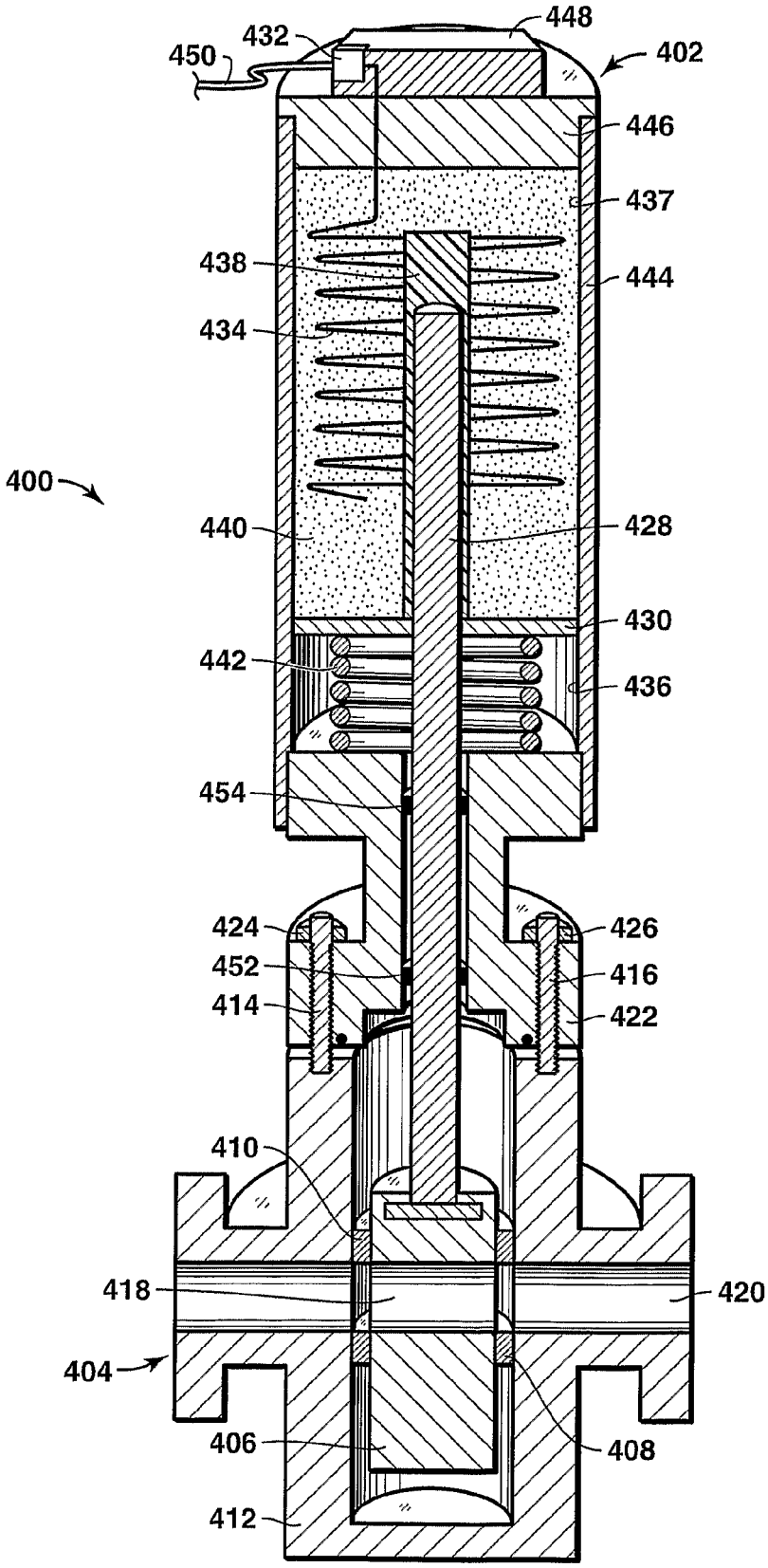
FIGS. 4A and 4B are exemplary embodiments of a partial cross section of the subsea tree valve of FIG. 1 having a thermal activation mechanism in accordance with certain aspects of the present techniques.
Figure 4B:
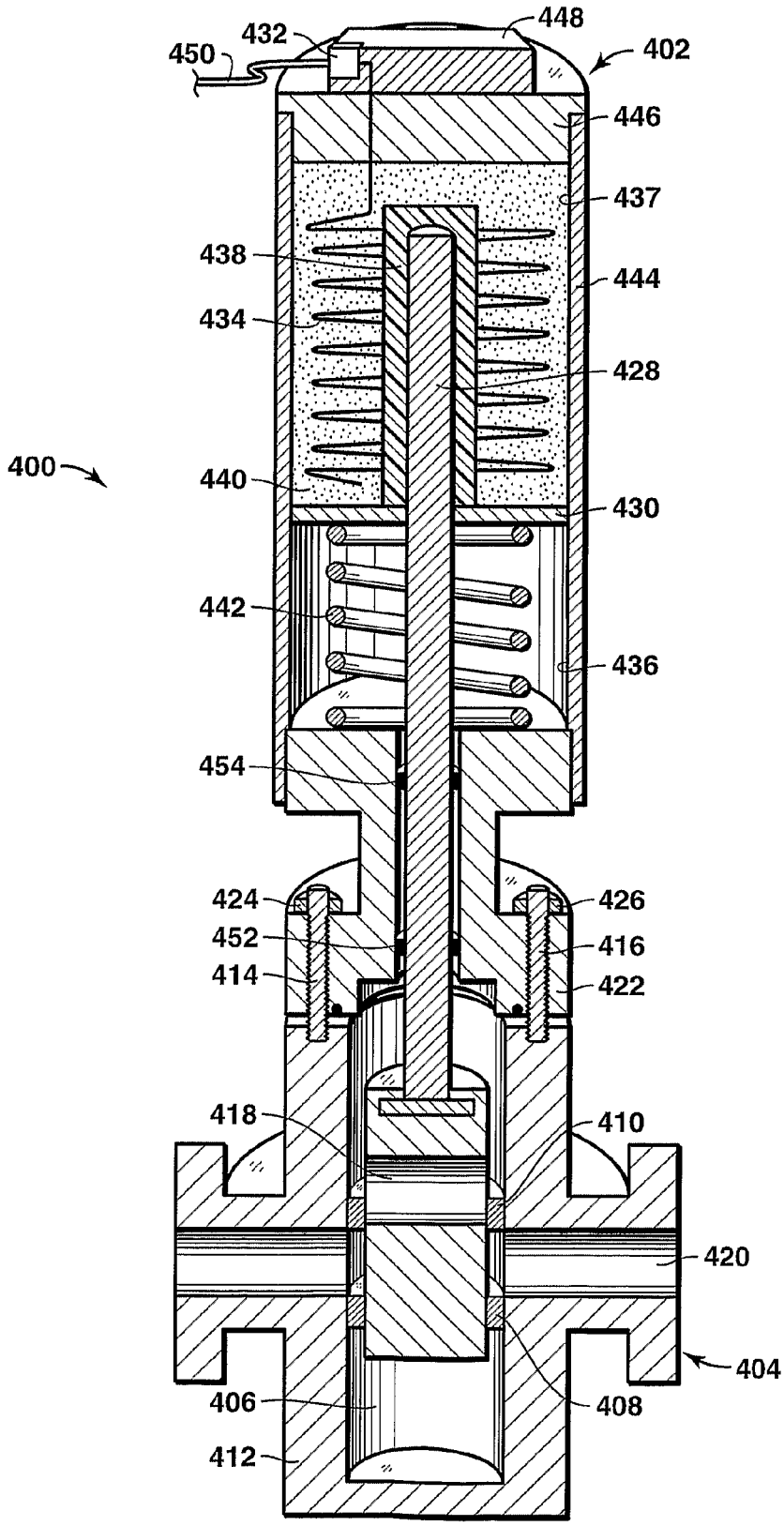

As another alternative embodiment, the present technique may also be utilized within a portion of the subsea tree 104 of FIG. 1, as shown in FIGS. 4A and 4B. Subsea trees, such as the subsea tree 104 of FIG. 1, are subsea devices that include various valves and interfaces between the wellbore 114 and the production facility 102, which may be separated by thousands of feet or one or more miles. These subsea trees may regulate the flow of fluids between the wellbore 114 and the production facility 102. While hydraulic valves may be utilized, each hydraulic control line presents certain issues associated with response time delays, leaks, manufacturing and operation costs, as noted above. These issues may be further compounded by the use of the subsea tree in deep-water applications, as an example. Further, while electric valves may also be utilized, these valves include complex technology and are not as reliable. Accordingly, the use of the thermal activation mechanism in a portion of subsea tree 104 may enhance the operation of the production system 100.

FIGS. 4A and 4B are exemplary embodiments of a partial cross section of the subsea tree 104 of FIG. 1 with a thermal activation mechanism 402 to control a valve 404 in accordance with certain aspects of the present techniques. In this embodiment, the portion of the subsea tree 104, which may be referred to by the reference numeral 400, includes another embodiment of the thermal activation mechanism 402 that controls the valve 404, such as a gate valve or ball valve. The thermal activation mechanism 402 includes an actuator that allows or blocks fluids from flowing through the valve 404. That is, the thermal activation mechanism 402 may be utilized to position the valve 404 into an open or closed configuration, in a manner similar to the discussion above.

The valve 404 includes a gate 406 and seating seals 408 and 410 that are housed within a valve body 412, and one or more bolts 414 and 416 that are external to the valve body 412. The gate 406 is slidably engaged within the valve body 412 to align a gate passage 418 with a valve body passage 420. In the open configuration, as shown in FIG. 4A, the gate passage 418 aligns with the valve body passage 420 to provide a fluid flow path through the valve body 412. In the closed position, as shown in FIG. 4B, the gate passage 418 is misaligned relative to the valve body passage 420 to disrupt the fluid flow path. The seating seals 408 and 410, which are each located between the valve body 412 and the gate 406, prevent fluid from flowing into the gate passage 414 or other portions of the valve body 412.

To control the valve 404, the thermal activation mechanism 402 is utilized to adjust the valve 404 between open and closed configurations. The thermal activation mechanism 402 may be divided into an interface portion and an actuator portion that are utilized to control the configurations of the valve 404. The interface portion of the thermal activation mechanism 402 is utilized to couple the actuator portion to the valve 404. The interface portion may include the adapter head 422 and nuts 424 and 426. The adapter head 422 is positioned adjacent to the valve body 412 and engages with the bolts 414 and 416. The nut 424 and bolt 414 are coupled together, while nut 426 and bolt 416 are coupled together. As such, the nuts 424 and 426 and bolts 414 and 416 form a secure coupling between the adapter head 422 and the valve body 412. It should be noted that other fasteners, such as pins, notches, glue or and/or other mechanisms, may couple the adapter head 422 and the valve body 412. Further, it should also be noted that the adapter head 422 has a central opening that provides access from the actuator portion of the thermal activation mechanism 402 to the valve gate 406 of the valve 404, as discussed below.

The actuator portion of the thermal activation mechanism 402 includes a member or rod 428, piston 430, control logic 432, heating element or coil 434, two variable volume chambers 436 and 437, squeeze boot 438, material 440, return spring 442, housing 444, end cap 446, cable junction box 448, control line 460 and actuator seals 452 and 454. In this embodiment, the rod 428 is engaged with the first and second variable volume chambers 436 and 437 that are separated by the piston 430. The first variable volume chamber 436 is formed by the adapter head 422, housing 444 and piston 430. The first chamber 436 includes a return spring 442 that compresses between the adapter head 422 and the piston 430 in the open configuration and expands to move the piston 430 in the closed configuration. Because the rod 428 passes through the first chamber 437, actuator seals 452 and 454 are utilized to isolate the first chamber from the valve body 412 and other external fluids. The second variable volume chamber 437 is formed by the piston 430, housing 444 and end cap 446. Within the second variable volume chamber 437, the heating coil 434 is disposed along with the material 440 and the squeeze boot 438. The material 440, which may be similar to the opening material 248 of FIGS. 2A and 2B, may be a paraffin, wax or other medium or substance that expands when the substance changes phases. The squeeze boot 438 is disposed around the rod 428 to isolate the rod 428 from the material 440. The heating coil 434, which may be similar to the heating coil 242 of FIGS. 2A and 2B, may be utilized to convert the material 440 between phases, which is discussed below.

External to the variable volume chambers 436 and 437, the cable junction box 448 is positioned adjacent to the end cap 446. The cable junction box 448 includes control logic 432 and provides a location that the control logic 432 may be coupled to the heating coil 434 and a control line 450, which may be cabling from the control umbilical 112, control line 130, or another cable. The control logic 432, which may operate similar to control logic 240 of FIGS. 2A and 2B, is configured to receive and respond to certain control signals on the control line 450. The control signals may be signals from the floating production facility 102 of FIG. 1 that indicate that the valve 406 is to be placed into a specific configuration.

To operate, the control logic 432 either provides current to the heating coil 434 or prevents current from flowing to the heating coil 434. For instance, in the open configuration, the control logic 432 may provide power or current to the heating coil 434. With this current, the heating coil 434 converts the material 440 into at least a partial liquid phase. Because the second chamber 437 is a sealed variable volume enclosure, the expansion of the material 440 forces the rod 428 and piston 430 to move, which expands the second chamber 437 and compresses the first chamber 436 and return spring 442. Also, because the rod 428 is attached to the gate 406, the movement of the gate 406 aligns the gate passage 418 with the valve body passage 420 to provide a fluid flow path through the valve 404.

Alternatively, in the closed configuration, the control logic 432 does not provide power or current to the heating coil 434. Without the current, the material 440 cools and converts from the at least partial liquid phase into an at least partial solid phase. Because the solid phase utilizes less volume than the liquid phase, the return spring 442 expands to move the rod 428 and piston 430, which decreases the size of the second chamber 437. This movement of the gate 406 misaligns the gate passage 418 relative to the valve body passage 420 to prevent fluid flow paths through the valve 404. It should be noted that without current being provided to the portion of the subsea tree 104, the thermal activation mechanism 402 fails into the closed configuration.

Beneficially, the use of the thermal activation mechanism 402 enhances the operation of the production system 100. For instance, as discussed above, the thermal activation mechanism 402 is responsive to control signals without the time delays exhibited in certain hydraulic systems based upon the length of the hydraulic control line. Further, the cost and design limitations associated with hydraulic control lines and pressure conduits is reduced or eliminated. Finally, the thermal activation mechanism 402 is a relatively simple mechanism that does not consume a large amount of space, but provides an efficient and reliable mechanism to control the valve 404 of the subsea tree 104.

Figure 5A:
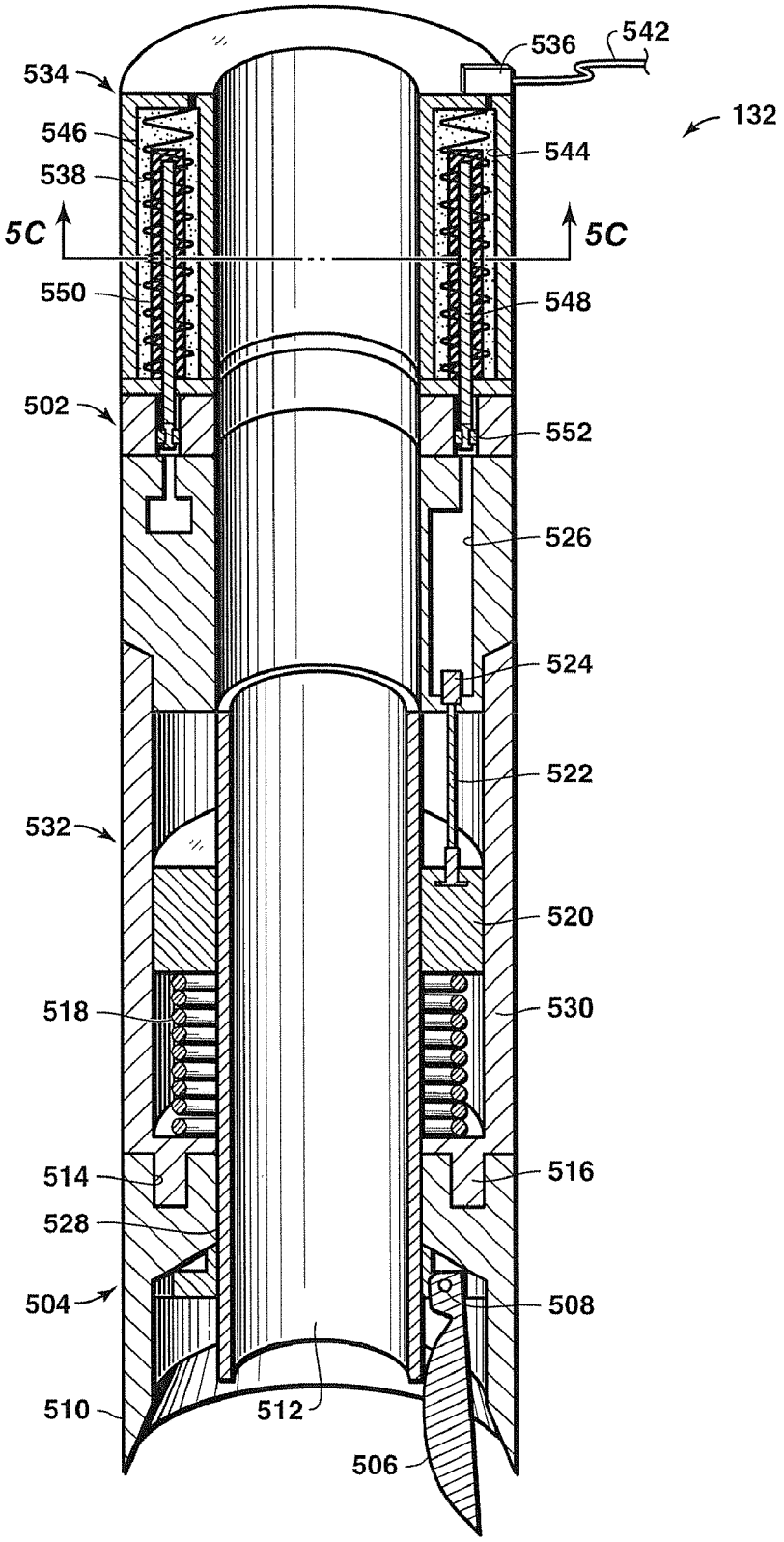
FIGS. 5A, 5B and 5C are exemplary embodiments of the subsurface safety valve of FIG. 1 having a thermal activation mechanism in accordance with certain aspects of the present techniques.
Figure 5B:
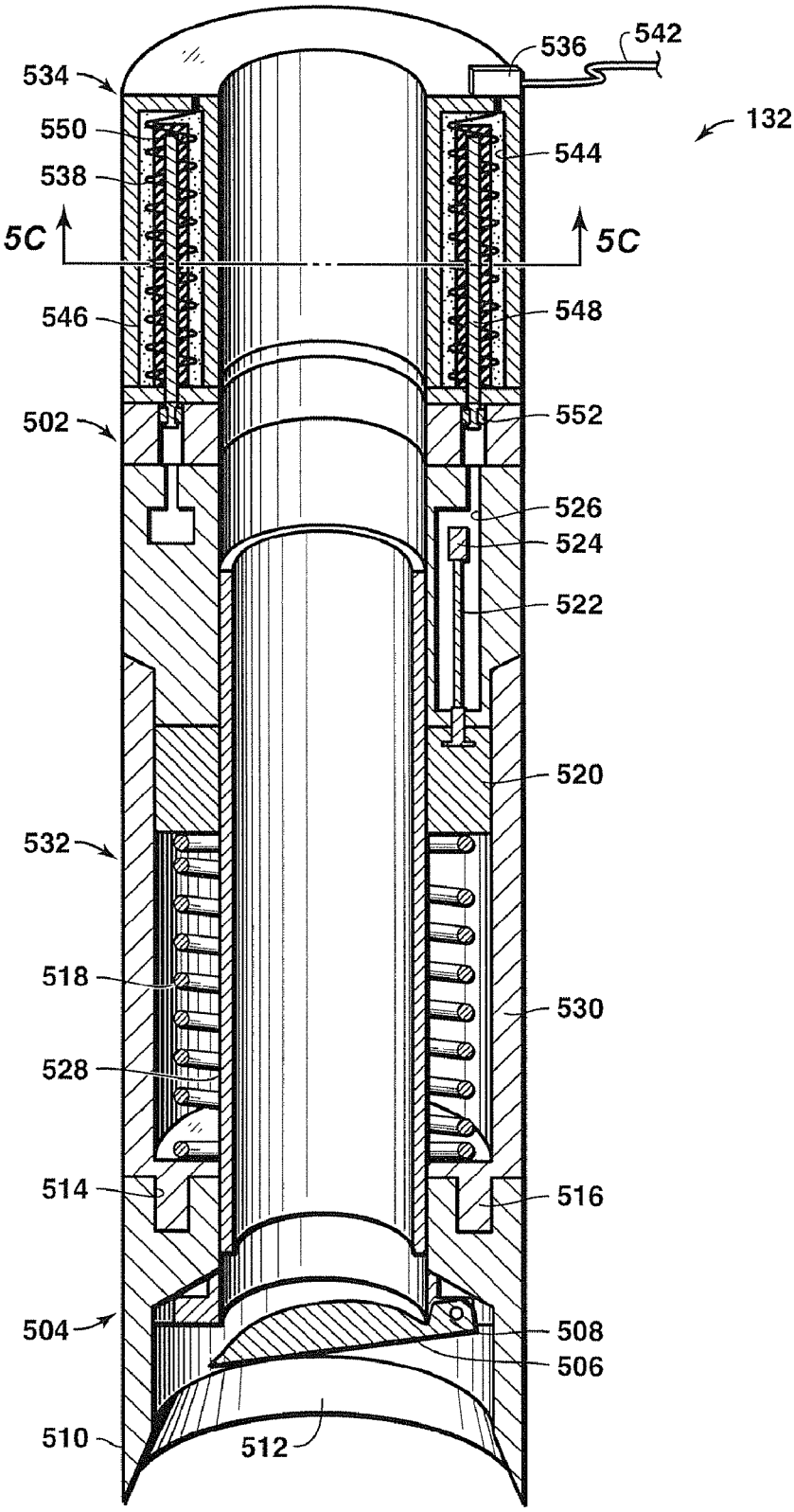

In addition to the use in a subsea tree, the present technique may also be utilized within subsurface safety valves, as shown in FIGS. 5A and 5B. Subsurface safety valves, such as the subsurface safety valve 132 of FIG. 1, are fail safe valves that provide closure of the production tubing 128. A surface facility, subsurface facility, or monitors within the wellbore 114 may control these subsurface safety valves. Accordingly, these valves are typically positioned at a location below the sea floor 106; such as below the mud line in an offshore well or near the lower end of the surface casing string 124, to prevent the escape of produced fluids in the event of some emergency. While hydraulic subsurface safety valves may be utilized, the hydraulic subsurface safety valves rely on hydraulic control lines. Again, each hydraulic control line presents certain issues associated with response time delays, leaks, manufacturing and operational costs. These issues may be further compounded by the use of the subsurface safety valves in deep-water applications, as an example. Also, while electric subsurface safety valves may also be utilized, these electric subsurface safety valves generally include complex electrical components, such as motors and gears. These components are not reliable in the harsh environment within the wellbore. Accordingly, exemplary embodiments of a subsurface safety valve utilizing the present techniques are further described in FIGS. 5A, 5B and 5C.

Figure 5C:
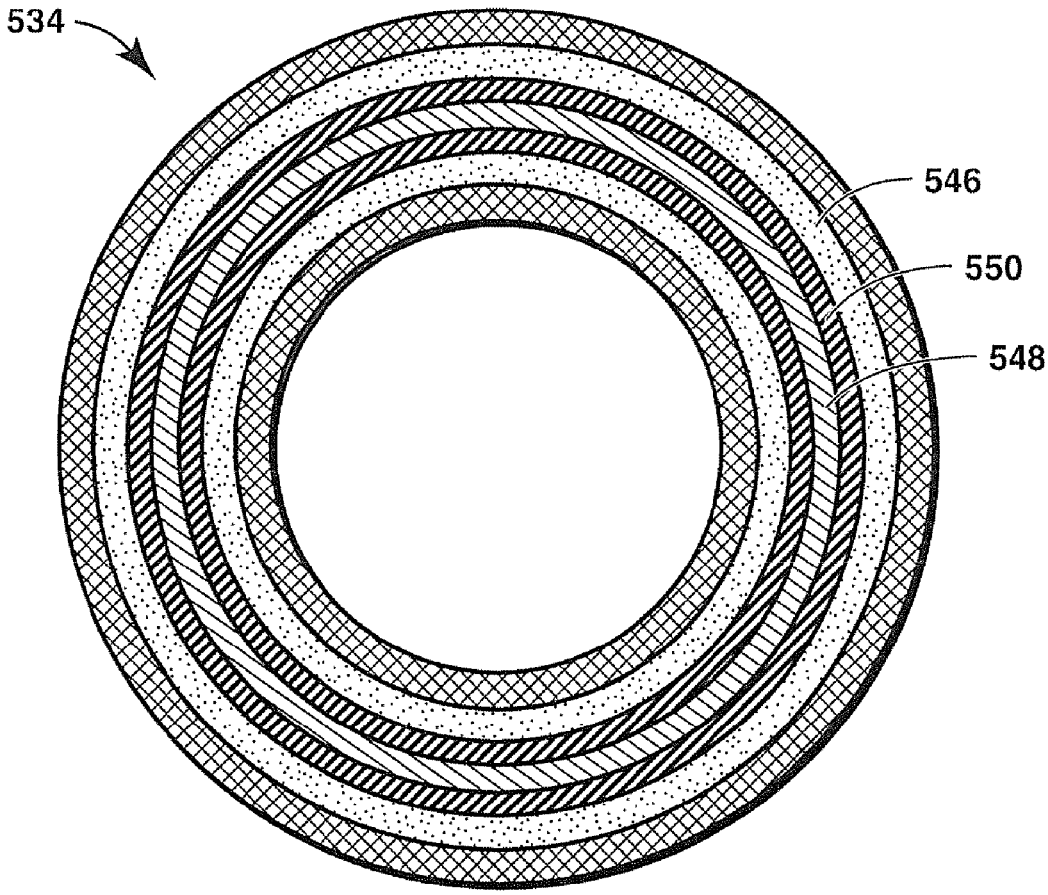

FIGS. 5A, 5B and 5C are exemplary embodiments of subsurface safety valve having a thermal activation mechanism in accordance with certain aspects of the present techniques. In this embodiment, the subsurface safety valve, which may be referred to by the reference numeral 132, includes a thermal activation mechanism 502 that controls a flapper assembly 504 to allow fluids to flow through a central opening or passage. The thermal activation mechanism 502 includes an actuator portion and flapper interface portion that each are utilized to adjust the flapper assembly 504. That is, the thermal activation mechanism 502 may be utilized to position a flapper 506 of the flapper assembly 504 into an open or closed configuration, in a similar manner to the discussions above.

The flapper assembly 504 includes the flapper 506 and a hinge 508 that are coupled to a flapper housing 510. The flapper 506, which is pivotally coupled to the hinge 508, rotates about the hinge 508 into an open and closed configuration. The hinge 508 may be a rod, pin, or other suitable fastener. In the open configuration, as shown in FIG. 5A, the flapper 506 does not interfere with the fluid flow path 512. However, in the closed configuration, as shown in FIG. 5B, the flapper 506 seats within the flapper housing 510 to prevent fluids from flowing through the flapper assembly 504. The flapper housing 510 has a notch 514 that is utilized to couple the flapper assembly 504 with the flapper interface portion of the thermal activation mechanism 502.

To control the configuration of the flapper assembly 504, the thermal activation mechanism 502 may be divided into a flapper interface portion 532 and actuator portion 534, which are utilized together to adjust the flapper assembly 504 between the open and closed configurations. The flapper interface portion 532 of the thermal activation mechanism 502 includes a power spring 518, spring piston 520, member or rod 522, hydraulic piston 524, hydraulic chamber 526, sleeve 528, and hydraulic housing 530. Within the hydraulic housing 530, the rod 522 is coupled between the spring piston 520 and hydraulic piston 524. The movement of the rod 522 depends on the forces produced by the power spring 516 and the hydraulic chamber 526, which is discussed below. The power spring 516 is configured to compress between the hydraulic housing 530 and the spring piston 520 in the open configuration and to expand by moving the spring piston 520 toward to the hydraulic chamber 526 in the closed configuration. The sleeve 528, which is attached to the spring piston 520, is slidably engaged within the hydraulic housing 530 to interact with the flapper 506 of the flapper assembly 504, which is discussed further below.

The actuator portion 534 of the thermal activation mechanism 502 is positioned concentrically with respect to the central opening in the subsea safety valve 132, which is shown along the line 5C in FIG. 5C. The actuator portion 534 is controlled by control logic 536, which may operate similar to the control logic 240 of FIGS. 2A and 2B. The control logic 536 may be coupled to heating element or coil 538 of the actuator portion 534 and the control line 542. The control line 542 may be cabling from the control umbilical 112, control line 130, or another cable. The control logic 536 is configured to receive and respond to certain control signals from the control line 542. The control signals may be signals from the floating production facility 102 of FIG. 1 that indicate whether the flapper assembly 504 is to be placed into the opened or closed configuration.

Similar to the opening actuator 206 of FIGS. 2A and 2B, the actuator portion 534 includes a heating coil 538, chamber 544, material 546, member or rod 548, squeeze boot 550, and seal 552. The heating coil 538 is disposed within the chamber 544 along with the material 546 and the squeeze boot 550. The material 546 may be the same material as the opening material 248 of FIGS. 2A and 2B or different material based on predetermined characteristics, such as expansion volume and/or operational temperature range, for example. The squeeze boot 550 is disposed around the rod 548 to isolate the rod 548 from the material 546. The seal 552 may isolate the material 546 from the hydraulic fluid in the hydraulic chamber 526.

To control the configuration of the flapper assembly 504, the control logic 536 either provides power or current to the heating coil 538 or prevents power or current from flowing to the heating coil 538. For instance, in the open configuration, the control logic 536 may provide current to the heating coil 538. With this current, the heating coil 538 converts the material 546 into at least a partial liquid phase. Because the chamber 544 is a sealed enclosure, the expansion of the material 546 force the rod 548 to be partially expelled from the chamber 544 into the hydraulic chamber 526. As a result, the hydraulic pressure increases within the hydraulic chamber 526, which forces the pistons 520 and 524 and rod 522 to compress the power spring 518. Because the sleeve 528 is attached to the spring piston 520, the spring piston 520 moves the sleeve 528 to dislodge the flapper 506 from the flapper housing 510. With the sleeve 528 forcing the movement of the flapper, the flapper 506 rotates about the hinge 508 to allow fluids to flow along the fluid flow path 512 through the flapper assembly 504.

Alternatively, in the closed configuration, the control logic 536 does not provide current to the heating coil 538. Without the current, the material 546 cools and converts from the at least partially liquid phase into an at least partial solid phase. Because the solid phase utilizes less volume than the liquid phase, the power spring 518 expands to move the rod 522 and pistons 520 and 524. This movement of the power spring 518 disengages the sleeve 528 from the flapper 506 to allow the flapper 506 to engage with the flapper housing 510. This seating of the flapper 506 with the flapper housing 510 blocks the fluid flow path 512. Also, the movement of the hydraulic piston 524 forces the rod 548 to move back into the chamber 544. It should be noted that this flapper assembly 504 is a fail-safe device because without current or power being provided to the thermal activation mechanism 502, the flapper assembly 504 fails into the closed configuration.

Beneficially, the use of the thermal activation mechanism 502 enhances the operation of the production system 100. For instance, as discussed above with the portion of the subsea tree 104, the thermal activation mechanism 502 is responsive to control signals without the time delays present in certain hydraulic subsurface safety valves. Further, the subsurface safety valve 132 reduces the risk associated with leakage into the environment or other problems with hydraulic control lines and pressure conduits. As such, the thermal activation mechanism 502 provides an efficient and reliable mechanism to control the subsurface safety valve 132 for the production system 100 of FIG. 1.

Figure 6A:
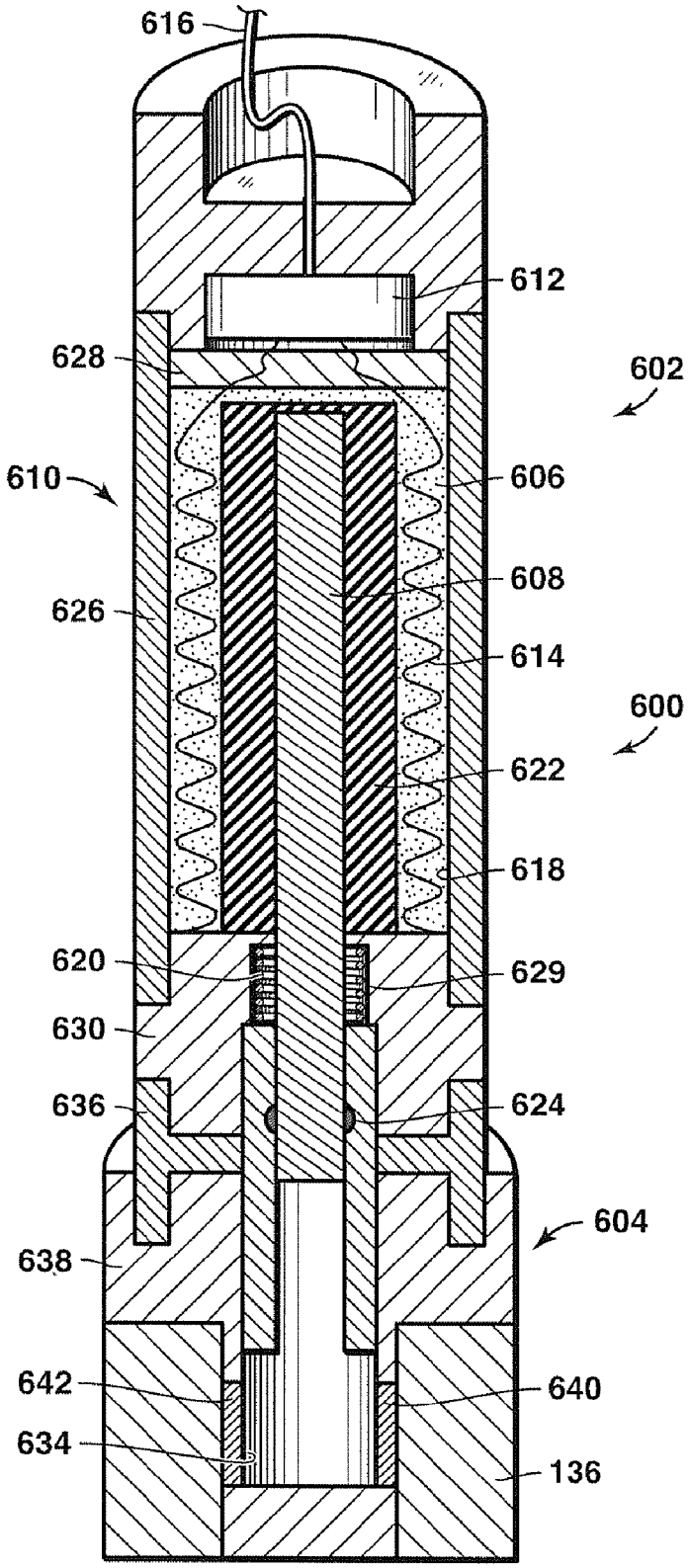
FIGS. 6A and 6B are exemplary embodiments of a setting tool having a thermal activation mechanism in accordance with certain aspects of the present techniques.
Figure 6B:
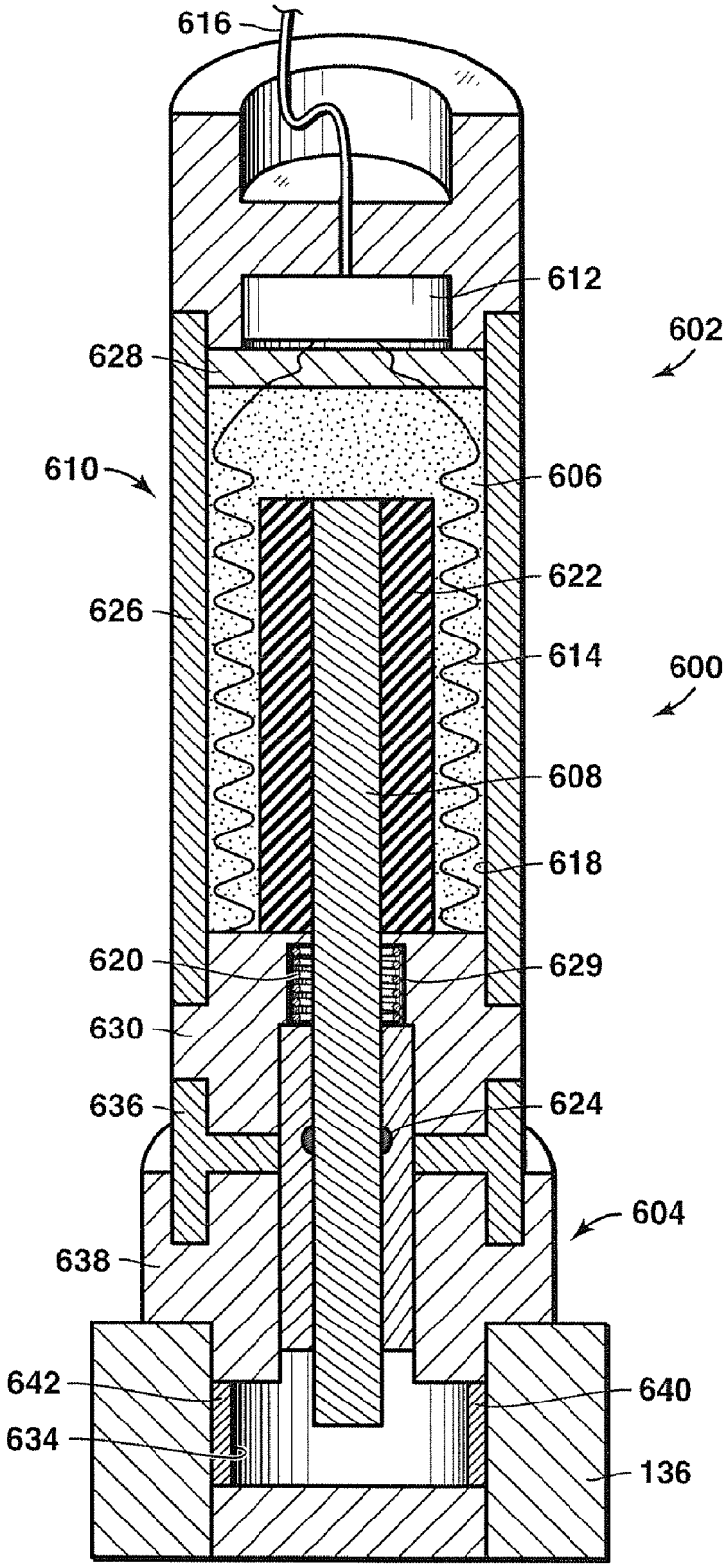

In a final exemplary embodiment, the present technique may also be utilized within a setting tool or setting assembly, as shown in FIGS. 6A and 6B. Setting tools may be utilized to place packers, such as the packers 136 of FIG. 1, plugs, retainers, whipstocks, and other similar tools within a wellbore. These setting tools may be configured to be retrievable or permanent tools, which may be deployed via pipe or wire into the wellbore. Packer setting tools typically use explosives to generate the forces required for setting packers and other devices. As noted above, these setting tools are dangerous, require special handling processes, are heavily regulated, are costly and increase risks associated with operation of a production system. Alternatively, setting tools may also include hydrostatic and electro-mechanical setting tools. The hydrostatic setting tools are limited to situations with the hydrostatic pressure in the well being high because the hydrostatic pressure available to the setting tool depends on the setting depth and the fluid density. That is, the hydrostatic setting tool is limited to deep well and high fluid density applications. The electro-mechanical setting tools, which are similar to the other electrical devices discussed above, include complex electric motor and gear systems to translate rotational motion into the linear force utilized to perform the application. As such, the problems with cost and reliability limit the use of these setting tools.

FIGS. 6A and 6B are exemplary embodiments of a setting tool having a thermal activation mechanism in accordance with certain aspects of the present techniques. In these embodiments, the setting tool, which may be referred to by the reference numeral 600, includes a thermal activation mechanism 602 that applies pressure to a packer interface 604 that sets a packer, such as packers 136 of FIG. 1, within a wellbore. The thermal activation mechanism 602 uses the volume expansion of a medium or material 606 to drive a member or rod 608, which operates similar to the discussions above.

The thermal activation mechanism 602 may be divided into a packer interface and actuator portions, which are utilized together to set the packer 136. The actuator portion of the thermal activation mechanism 602 includes at least one actuator 610 that is managed by control logic 612. The control logic 612, which may operate similar to the control logic 240 of FIGS. 2A and 2B, may be coupled to a heating element or coil 614 and a control line 616, which may be similar to the control line 241 of FIGS. 2A and 2B. The control logic 612 is configured to receive and respond to certain control signals from monitors or sensors (not shown). The control signals and power are provided via the electric cable/control line, which may include a portable service unit, used to deploy the packer. These control signals may indicate that the setting tool 600 is to set the packer 136 at a specified location within the wellbore 114.

Similar to the opening actuator 206 of FIGS. 2A and 2B, the actuator 610 includes the heating coil 614, actuator chamber 618, material 606, rod 608, return spring 620, squeeze boot 622, seal 624, actuator housing 626, end cap 628 and actuator head 630. The actuator housing 626, end cap 628, and actuator head 630 form sealed variable volume enclosure of the actuator chamber 618. Within the actuator chamber 618, the heating coil 614 is disposed along with the material 606 and the squeeze boot 622. The material 606 may be the same material as the opening material 248 of FIGS. 2A and 2B or different material based on predetermined characteristics, such as expansion volume and/or operational temperature range. The return spring 620 is disposed within a spring chamber 629 of the actuator head 630 and attached to the rod 608 that passes through the actuator head 630. The operation of the actuator portion is discussed below in greater detail.

The packer interface portion of the thermal activation mechanism 602 may be utilized to couple the setting tool 600 with the packer 136. The packer interface includes a hydraulic chamber 634, connection sleeve 636, hydraulic housing 638 and pistons 640 and 642. The connection sleeve 636, which has a central opening that allows the rod 608 to pass into the hydraulic chamber 632, is configured to engage with the actuator head 630 and hydraulic housing 638 to form a secure coupling between the actuator head 630 and hydraulic housing 638. The hydraulic housing 638, connection sleeve 636 and pistons 640 and 642 form the hydraulic chamber 634. The hydraulic chamber 634 is a variable volume chamber that includes a hydraulic fluid. As the hydraulic pressure increases within the hydraulic chamber 634, the hydraulic fluid forces the pistons 640 and 642 to expand toward the wellbore to set the packer 136, which is discussed further below.

The operation of the setting tool 600 involves a contracted or closed configuration along with an expanded or open configuration. The closed configuration is utilized to move the setting tool 600 and packer 136 into a specific location within the wellbore. In the contracted configuration, the control logic 612 does not provide power or current to the heating coil 614. Without the current, the material 606 remains and/or converts from the at least partially liquid phase into an at least partial solid phase. Because the solid phase utilizes less volume than the liquid phase, the return spring 620 contracts to move the rod 608 toward the actuator chamber 618. This movement of the rod 608 decreases the hydraulic pressure in the hydraulic chamber 634. Accordingly, the pistons 640 and 642 may disengage with packers 136 or remain in the contracted configuration, which enables the packer 136 and/or the setting tool 600 to move within the wellbore.

Alternatively, once the packer 136 is positioned at the appropriate location, the setting tool 600 may be activated to operate in the expanded configuration. In the expanded configuration, the control logic 612 provides current to the heating coil 614. With this current, the heating coil 614 converts the material 606 into at least a partial liquid phase. Because the chamber 618 is a sealed variable volume enclosure, the expansion of the material 606 forces the rod 608 to be at least partially expelled from the chambers 618 and to enter into the hydraulic chamber 634. The movement of the rod 608 compresses the return spring 620 and increases the hydraulic pressure within the hydraulic chamber 634. As a result of the increase in the hydraulic pressure, the pistons 640 and 642 apply force on the packer 136 to move the packer 136 toward the walls of the wellbore.

Beneficially, the use of the thermal activation mechanism 602 in the setting tool 600 provides an efficient mechanism for setting packers within the wellbore 114 of the production system 100 of FIG. 1. For instance, the setting tool 600 reduces or eliminates safety, logistical and operational problems associated with the explosive setting tools. That is, the setting tool 600 does not have the problems associated with the installation of the explosive igniters and powder charge, maintenance of explosive components (failed explosions and successful uses), cost of replacing the seals and other components within the setting tool. Further, the thermal activation mechanism 602 does not rely on well hydrostatic pressure for actuation energy. This allows the setting tool to be utilized in shallow applications, long-interval applications and/or with different wellbore fluid densities. Finally, because the setting tool 600 may be deployed within the wellbore 114 via wire, the setting tool 600 provides a flexible approach for deployment into a wellbore over other techniques.

In addition, it should be appreciated that the present embodiments are simplified applications of the present techniques. The thermal activation mechanisms of the present techniques may also include different designs and layouts for the various components and portions. For instance, the actuators utilized in the present techniques may be separated into multiple chambers disposed around the tool or valve in a concentric, eccentric or other configuration. Alternatively, the actuators may include a single chamber that is concentric with the shape of the tool or valve. Regardless of the specific spatial layout of the actuators, the thermal activation mechanisms may utilize the variable volume change in a medium or material to create hydraulic pressure for a valve or tool.

Furthermore, the thermal activation mechanisms may also include one or more actuators that are designed to provide additional force for certain applications. As an example, to provide more force for a specific application, the two or more actuators may be combined in series, parallel and/or a combination thereof (i.e. pyramid of actuators). In this manner, the two or more actuators may work together to increase the hydraulic pressure for the specific application. This type of configuration may utilize the combined force from different actuators to increase the force or linear displacement generated for certain applications.

The thermal activation mechanisms may also be designed to enhance the responsiveness of the device. For instance, while the conversion rate of the material is based on the power provided to the heating elements, the actuators may be designed to open or close quickly for different applications. These designs may involve using a material or medium that changes between phases at a specified rate or providing additional power to convert the material at a faster rate. For instance, the material may be pre-heated by the heating coils to a temperature below the phase conversion temperature for the material. Then, when the device is to be activated, the heating coil may increase the temperature of the material to convert the material between phases. Additionally, the conversion of the material into a solid or cooler phase may be managed by adjusting the ambient conditions of the device or well. For instance, for a subsea tree, the environment, which includes seawater around the well, may be cooler than the actual temperature within the wellbore. As such, the seawater may be utilized to cool the actuator quickly to return the valve to a closed configuration.

Also, while the member or rod is described as being at least partially within the actuator chamber, it should also be noted that the rod is simply one embodiment of the present techniques. For instance, the rod, which may be external to the actuator chamber, may be coupled to a piston partially within the actuator chamber. The movement of the piston may move the rod in a manner similar to the discussions above. Similarly, the actuator chamber may be separated into a hydraulic chamber and an actuator chamber by a flexible seal or piston. Because the actuator chamber includes the material with the heating coil, the pressure within the hydraulic chamber may increase as current is provided to the heating coil and the material in the actuator chamber expands. Also, the actuator chamber may be configured to a device, such as a rod, member or gate, in a manner that rotates the device between one or more positions or configurations. Thus, a variety of different embodiments of the thermal activation mechanism may be utilized in accordance with other embodiments of the present techniques.

Moreover, the thermal activation mechanism may include additional mechanisms to further enhance the operation of the device. That is, a locking mechanism may be utilized to maintain the device in a specific configuration. For instance, a valve may include a primary actuator and a lock actuator. In the open configuration, a latch may be engaged to hold a valve in the open configuration. The latch mechanism may be activated by the lock actuator, which operates in a manner similar to the actuators discussed above. Once the valve is latched into the open configuration, the power provided to the primary actuator may be shut off because the lock actuator may maintain the valve in the open configuration. That is, as long as current is provided to the lock actuator, the valve remains in the open configuration. Without the current, the material in the primary actuator may convert back into a solid phase to allow the rod to retract back into the primary actuator chamber. As such, the valve may close when the material in the lock and primary actuators cool and the associated return springs disengage the rods to allow the valve to the back to the closed configuration.

As another possible embodiment, the thermal activation mechanism may include a battery that converts the material from the first phase to a second phase, as discussed above. For example, with a setting tool, such as setting tool 600 of FIGS. 6A and 6B, the control logic may be coupled to a battery that is utilized to set the packer 136 at a specific location within the wellbore. The control logic may set the packer when a sensor indicates a specific depth within the wellbore has been reached or through wireless communication with another device associated with the well. Regardless, in this embodiment, the battery provides the power to the thermal activation mechanism to convert the material from a first phase to a second phase. With this power or current, the thermal activation mechanism may operate in a manner similar to the discussion above.

In addition, as noted above the present embodiments may be utilized for injection applications. For instance, the embodiments of the apparatuses may include a valve and one or more actuators coupled together. In the first configuration, treatment fluids, such as water, gas, oil, and/or other fluids, may be injected through the valve into the wellbore. In a second configuration, the flow of fluids may be prevented into the wellbore. The treatment fluids may include oil, gas, water, or other fluids, such as simulation fluids known in the art.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. An apparatus associated with the production of hydrocarbons comprising:

a body having a passage to allow hydrocarbons to flow through the apparatus;

one or more actuators associated with the body, each of the actuators comprising:

at least one heating element, wherein each of the at least one heating elements is disposed within a chamber of the body along with an actuator material, a member at least partially coupled to the chamber and adapted to move in a direction substantially parallel to the passage, wherein the member is configured to:

extend to a first configuration when the at least one heating element converts at least a portion of the actuator material from a first phase to a second phase;

contract to a second configuration when the actuator material converts from the second phase to the first phase;

a hydraulic chamber in communication with the member, wherein the first configuration increases the hydraulic pressure within the hydraulic chamber and the second configuration reduces the hydraulic pressure within the hydraulic chamber; and a sleeve in communication with the hydraulic chamber, wherein the sleeve provides a first configuration that provides a sleeve passage, a second configuration that blocks fluid flow through the sleeve passage, and other configurations that limit the amount of fluid flow through the sleeve passage.

2. The apparatus of claim 1 wherein the first configuration allows hydrocarbons to flow through the passage of the body and the second configuration prevents the flow of hydrocarbons through the passage of the body.

3. The apparatus of claim 1 comprising a cable external to the chamber and coupled to the at least one heating element to provide power to the heating element.

4. The apparatus of claim 3 comprising control logic coupled between the at least one heating element and the cable, wherein the control logic is configured to determine whether to supply power to the at least one heating element.

5. The apparatus of claim 4 wherein the control logic is configured to communicate with a device external to the apparatus via the cable.

6. The apparatus of claim 4 comprising a closing actuator associated with the body, the closing actuator having a closing heating element disposed within a closing chamber of the body along with a closing actuator material, wherein the closing heating element is coupled to the control logic.

7. The apparatus of claim 6 wherein the control logic is configured to:

provide power to the at least one heating element to extend the member to the first configuration when indicated by a first control signal on the cable; and provide power to the closing heating element to contract the member to the second configuration when indicated by a second control signal on the cable.

8. The apparatus of claim 1 comprising:

a locking heating element disposed within a locking chamber along with a locking material, a latch coupled to the locking chamber, wherein the latch is configured to:

lock the member into the first configuration when the locking heating element converts at least a portion of the locking material from a first phase to a second phase; and release the member to the second configuration when the locking material converts from the second phase to the first phase.

9. The apparatus of claim 1, comprising a piston in communication with the hydraulic chamber, wherein the piston is configured to expand toward the wellbore to set a device in the first configuration.

10. The apparatus of claim 1, wherein the material expands when converted from the first phase to the second phase.

11. The apparatus of claim 10, wherein the material expands by at least about 15% when converted from the first phase to the second phase.

12. The apparatus of claim 10, wherein the material expands in a range from about 10% to about 20% when converted from the first phase to the second phase.

13. The apparatus of claim 1 wherein the actuator material is wax or paraffin.

14. A method for producing hydrocarbons comprising:

disposing an apparatus having a thermal activation mechanism within a wellbore, wherein the apparatus comprises a sleeve in communication with a hydraulic chamber, wherein the sleeve provides a first configuration that provides a sleeve passage and a second configuration that blocks fluid flow through the sleeve passage, and other configurations that limit the amount of fluid flow through the sleeve passage;

converting at least a portion of a material in the thermal activation mechanism from a first phase to a second phase to place the apparatus into the first configuration, wherein the first configuration increases the hydraulic pressure within the hydraulic chamber; and converting at least a portion of a material in the thermal activation mechanism from the second phase to the first phase to place the apparatus into the second configuration, wherein the second configuration reduces the hydraulic pressure within the hydraulic chamber.

15. The method of claim 14 comprising receiving a control signal from a cable external to the apparatus and coupled to the heating element to provide power to the heating element.

16. The method of claim 14 comprising:

converting at least a portion of a locking material in a locking actuator from a first phase to a second phase to lock the apparatus into the first configuration; and converting at least a portion of the locking material in the locking actuator from the second phase to the first phase to release the apparatus to the second configuration.

* * * * *